US011156055B2

(12) United States Patent
Rao

(10) Patent No.: US 11,156,055 B2
(45) Date of Patent: Oct. 26, 2021

(54) LOCKING MECHANISM FOR SUBSEA COMPACT CUTTING DEVICE (CCD)

(71) Applicant: WORLDWIDE OILFIELD MACHINE, INC., Houston, TX (US)

(72) Inventor: Reddi Udaya Bhaskara Rao, Singapore (SG)

( * ) Notice: Subject to any disclaimer, the term of this patent is extended or adjusted under 35 U.S.C. 154(b) by 276 days.

(21) Appl. No.: 16/259,081

(22) Filed: Jan. 28, 2019

(65) Prior Publication Data

US 2019/0153802 A1 May 23, 2019

Related U.S. Application Data

(63) Continuation-in-part of application No. 15/806,919, filed on Nov. 8, 2017, now Pat. No. 10,655,421, which is a continuation-in-part of application No. 15/647,490, filed on Jul. 12, 2017, now Pat. No. 10,316,608, which is a continuation of application No. 14/518,404, filed on Oct. 20, 2014, now Pat. No. 9,732,576.

(60) Provisional application No. 62/669,536, filed on May 10, 2018, provisional application No. 62/650,710, filed on Mar. 30, 2018, provisional application No. 62/650,688, filed on Mar. 30, 2018.

(51) Int. Cl.

| | |
|---|---|
| ***E21B 33/06*** | (2006.01) |
| ***E21B 41/00*** | (2006.01) |
| ***E21B 33/035*** | (2006.01) |

(52) U.S. Cl.

CPC ..... *E21B 33/063* (2013.01); *E21B 33/0355* (2013.01); *E21B 41/0007* (2013.01)

(58) Field of Classification Search

CPC ..... E21B 33/063; E21B 33/06–064; E21B 29/08; E21B 29/00; E21B 33/0353; E21B 33/0355; Y10T 83/9447; Y10T 83/0581; Y10T 83/0596

USPC ..... 166/55, 85.4, 297, 298, 361, 364, 379, 166/387, 363

See application file for complete search history.

(56) References Cited

U.S. PATENT DOCUMENTS

| | | | | |
|---|---|---|---|---|
| 3,561,526 A | | 2/1971 | Meynier, III et al. | |
| 4,081,027 A | | 3/1978 | Nguyen | |
| 4,969,390 A | * | 11/1990 | Williams, III | B23Q 1/28 251/1.1 |
| 5,515,916 A | | 5/1996 | Haley | |

(Continued)

FOREIGN PATENT DOCUMENTS

| | | |
|---|---|---|
| WO | 2006/048669 | 5/2006 |
| WO | 2007/122365 | 11/2007 |

(Continued)

*Primary Examiner* — George S Gray

(74) *Attorney, Agent, or Firm* — Kenneth L. Nash; Thomas D. Nash

(57) ABSTRACT

A locking mechanism for a subsea cutting/sealing device to seal a wellbore and cut any drill pipe in the wellbore. The subsea cutting/sealing device locks two pipe cutters in a closed position utilizing locking mechanisms on two position rods. The position rods are part of a visual indicator that an ROV camera or diver may use to determine whether the pipe cutter is closed or open position. The locking mechanism operates according to a sequence of operation for opening/closing the pipe cutters. An ROV tool can be used that is capable of operating the locking mechanism as well as opening and closing the subsea cutting sealing device.

20 Claims, 25 Drawing Sheets

Locking Mechanism
Locked

(56) References Cited

U.S. PATENT DOCUMENTS

| | | | | |
|---|---|---|---|---|
| 6,173,770 | B1 | 1/2001 | Morrill | |
| 6,357,529 | B1 | 3/2002 | Kent et al. | |
| 6,601,650 | B2 | 8/2003 | Sundararajan | |
| 8,353,338 | B2 | 1/2013 | Edwards | |
| 8,740,174 | B2 | 6/2014 | Juda et al. | |
| 8,800,954 | B2 | 8/2014 | Edwards | |
| 9,732,576 | B2 | 8/2017 | Rao | |
| 2003/0029619 | A1 | 2/2003 | Sundararajan | |
| 2006/0113501 | A1 | 6/2006 | Isaacks | |
| 2010/0218955 | A1 | 9/2010 | Hart | |
| 2014/0034316 | A1 | 2/2014 | Larson | |
| 2014/0069531 | A1* | 3/2014 | Jaffrey | E21B 33/076 137/553 |
| 2016/0102518 | A1 | 4/2016 | Araujo | |
| 2016/0138356 | A1 | 5/2016 | Ellison | |
| 2017/0175927 | A1* | 6/2017 | Kotrla | E21B 33/062 |
| 2017/0328165 | A1 | 11/2017 | Rao | |

FOREIGN PATENT DOCUMENTS

| | | |
|---|---|---|
| WO | 2012/000098 | 1/2012 |
| WO | 2014/144792 | 9/2014 |

* cited by examiner

Locking Mechanism Locked

Locking Mechanism Ready to Lock

Locking Mechanism in the Unlocked Position

Closed and Unlocked

Closed and Unlocked

Closed and Locked

Open and Unlocked

Open and Unlocked

CCD Opened and Unlocked

CCD Closed and Locked

CCD Opened and Unlocked

CCD Closed and Locked

LOCKING MECHANISM FOR SUBSEA COMPACT CUTTING DEVICE (CCD)

FIELD OF THE INVENTION

The present invention relates generally to a subsea CCD that is used to seal a wellbore and cut any drill pipe in the wellbore. More specifically, the present invention relates to a locking mechanism that locks the two cutters in a closed position. The moving parts of the system operate the locking mechanism to securely lock and unlock in a sequence thereby allowing the safe operation of opening and closing of the CCD. The present invention also teaches an override tool that is capable of operating the locking mechanism utilizing an ROV in case the hydraulics of the CCD are no longer available. The CCD may be referred to herein generically as a subsea pipe cutter.

BACKGROUND OF THE INVENTION

U.S. application Ser. No. 15/806,919 filed Nov. 8, 2017 is incorporated herein by reference. U.S. application Ser. No. 15/806,919 filed Jul. 12, 2017 is incorporated herein by reference. U.S. Pat. No. 9,732,576 issued Aug. 15, 2017 is also incorporated herein by reference.

Surface and subsea pipelines are subject to high pressure fluid flows. During operation, shear rams, gates or other subsea sealing/cutting devices may be utilized to safely shear a pipe or other physical objects present in the wellbore. The term subsea pipe cutter may be referred generically to as BOP shear rams, dual gate valves, dual gates and/or other devices utilized to shear pipe and seal a subsea well. Cutters may be referred to as the gates or the shear rams. To ensure well safety, it is paramount to utilize a device to consistently and reliably cut a pipe and other physical objects in the wellbore to avoid potential catastrophic blowouts, spills, or other dangerous situations that may arise which are inherent in the pipeline operations.

Wells may be repeatedly sealed during normal operations such as workovers to fix any associated problems that have arisen or due to inclement weather whereby changes in tide, wind, and the like may cause damage to the pipe, rigs, equipment, or personnel. A system that is able to seal a well and cut pipe or other objects is essential to the proper function of drilling operations.

It is often desirable that position indicators are incorporated on all actuators. The position indicators show valve position (open/close and full travel) for observation by a diver/ROV. For some standards where the actuator incorporates ROV override, the position indicator should be visible from the working ROV.

In some cases, standards for original equipment suppliers (OEMs) are specified. For example they may require that rams equipped with hydraulic ram locks should automatically engage and maintain a preload on removal of actuator closing and/or locking pressures. In this case, ram locking devices may be required to be designed to maintain preload to affect a seal under the following conditions: can repeatedly maintain a wellbore pressure seal after removing the actuator closing and/or locking pressures at room temperature, minimum and maximum design temperatures, and as a function of time; maintain a closing pressure margin (e.g., typically 25%) above that required to effect a seal; for pipes and slip rams, maintain a closing pressure margin (e.g., typically 25%) above that required to prevent slippage at maximum-rated hang-off load for rams located in the WCP (Well Control Package), allow for unlatch and re-latch of the EDP (Emergency Disconnect Package) without loss of preload. Single failures of the ram lock mechanisms shall not result in loss of functionality. Once the cutting device is closed, it may be required that means be used to prevent internal pressure inside the cutting device from opening the cutters of the cutting device to allow fluid flow through the bore that extends through the cutting device.

The standards do not state a mechanism to implement the regulations or the sequences required to achieve them. Therefore, there is a need for such a specific system and procedure to meet these standards.

Accordingly, those of skill in the art will appreciate the present invention that provides the locking mechanisms, a sequence of operation for the locking mechanisms and an override tool that is able to work with the locking mechanisms to open and close the valves remotely.

SUMMARY OF THE INVENTION

One possible object of the present invention is to provide a hydraulically actuated locking mechanism for a pipe cutting system.

Another possible object of the present invention is to provide an override tool that may be deployed and utilized to operate a pipe cutting system in the event the pipe cutting device cannot be controlled under standard operating conditions. The override tool will also be able to access the otherwise hydraulically locking and unlocking mechanism of the cutters. So if the hydraulic system of the cutting/sealing device is no longer operational due to a blowout or the like, the override tool is able to operate the locking mechanism.

Yet still another object of the present invention is to provide a sequence of operation that may be utilized to lock and unlock a locking mechanism on a pipe cutting/sealing system wherein, upon the proper sequence of operation, the pipe cutting system may then be opened or closed.

These and other objects, features, and advantages of the present invention will become clear from the figures and description given hereinafter. It is understood that the objects listed above are not all inclusive and are only intended to aid in understanding the present invention, not to limit the bounds of the present invention in any way.

One general aspect includes a locking mechanism for a subsea pipe cutter comprising a subsea pipe cutter housing. First and second cutters are connected to respective first and second pistons. The first and second pistons are responsive to hydraulic fluid to move the first and second cutters from an open position to a closed position. In the closed position, the first and second cutters shear pipe when a pipe is within the subsea pipe cutter. First and second position shafts are rigidly connected to the first and second pistons. The first and second position shafts extend outside the subsea pipe cutter housing past the outer wall of the piston chamber and are connected to first and second visual indicators that show whether the first and second cutters are in the open position or the closed position. The first and second position shafts define first and second openings. First and second piston rods connect to the first and second pistons and the first and second cutters. The first and second position shafts are connected to the first and second pistons on an opposite side of the first and second pistons from the first and second piston rods. First and second locking members for the first and second position shafts. The first and second locking members being positioned along the first and second position shafts at a fixed distance with respect to the subsea pipe cutter housing. The first and second locking members are moveable between a locked position and an unlocked position. In the unlocked position, the first and second locking members are outside the first and second openings on the first and second position shafts. When the first and second cutters are in the closed position, then the first and second locking members are moveable to the locked position in the first and second openings in the first and second position shafts to fix the first and second cutters in the closed position. The first and second locking members are moveable to the unlocked position outside the first and second openings to permit movement of the first and second cutters to the open position.

Implementations may comprise the locking mechanism further comprises each of the first and second locking members is sized with a diameter smaller than a diameter of the first and second position shafts to fit within the first and second openings formed in the first and second position shafts. The first and second lock sliders are movable between an unlocked position and a locked position. In the unlocked position, the first and second lock sliders are shaped to permit the first and second locking members to remain in the unlocked position outside the first and second openings on the first and second position shafts. In the locked position, the first and second lock sliders are shaped to urge the first and second locking members into the first and second openings. The first and second lock sliders are slidable in response to hydraulic pressure. The first and second lock sliders each comprise a recess and a lock surface. In the unlocked position, the first and second lock sliders are slidably positioned so that the recess in the first and second lock sliders receives the first and second locking members. In the locked position, the first and second lock sliders are slidably positioned so that the lock surface of the first and second lock sliders engages the first and second locking members to urge the first and second locking members into the first and second openings. The first and second visual indicators comprise first and second position indicators movable with the first and second position shafts. In the closed position, the first and second position indicators are configured to engage first and second valve switches. Each of the first and second valve switches is operable to direct a first and second valve to allow fluid flow to move the first and second lock sliders to the locked position or the unlocked position. In the open position, the first and second position indicators are positioned away from the first and second valve switches, the first and second valves switches being closed. In the unlocked position, the first and second lock sliders, the first and second valves are configured to stop fluid flow to the first and second lock sliders. The first and second valves may be four-way two-way valves.

The locking mechanism further comprising the first and second lock sliders are each linked respectively to first and second valve switches. The first and second valve switches being responsive to movement of the first and second lock sliders. The first and second valve switches are operable to direct first and second valves to allow fluid flow to move the first and the second pistons to the open or closed position. The locking mechanism may also include in the closed position, the first and second lock sliders are configured to maintain the first and second valve switches to operate the first and second valves to direct fluid to the first and second pistons. The locking mechanism may also comprise in the open position, the first and second lock sliders are operable to move the first and second valve switches to prevent fluid from flowing to the first and second pistons Another general aspect comprises an override tool for a subsea pipe cutter. The subsea pipe cutter comprises a pipe cutter housing and a bore through the pipe cutter housing. A cutter is connected to a position rod. A piston moves with the position rod and the cutter between an open and a closed position with respect to the bore. A lock is mounted adjacent to the position rod to lock or unlock movement of the position rod and the cutter when the cutter is in the closed position. The position rod is connected to visual indicators that visually show whether the cutter is in an open position or a closed position from a location external to the subsea pipe cutter.

The override tool comprises an override tool cylinder. The override tool also comprises a piston mounted in the override tool cylinder. An override tool piston rod is connected to the piston. An override tool housing has a housing connector connectable to the pipe cutter housing to secure the override tool cylinder from movement with respect to the pipe cutter housing. A coupler is on the override tool piston rod, the coupler being connectable to the position rod. The override tool is attachable and detachable to the subsea pipe cutter. The housing connector being connectable the pipe cutter housing and the coupler being connectable to the position rod so that the piston is moveable to move the cutter between the open position and the closed position. The override tool also comprises a lock adaptor, the lock adaptor being connectable to the lock on the subsea pipe cutter to lock and unlock the position rod when the pipe cutter is in the closed position.

The override tool is selectively mountable to a remotely operable vehicle. The coupler includes an enlarged portion that interconnects to the position rod.

The override tool includes a profile that permits the visual indicators to be visible when the override tool is secured to the subsea pipe cutter.

The lock adaptor is hydraulically activated.

The override tool has an open side wherein the housing connector, the coupler, and the lock adaptor are configured to be mountable to a lock mechanism from above the lock mechanism whereby the override tool is lowered onto the lock mechanism for mounting when the subsea pipe cutter is in position for operation.

One general aspect includes a sequence of operation for a locking mechanism for a subsea pipe cutter. The subsea pipe cutter defines a bore through the subsea pipe cutter. The subsea pipe cutter has first and second cutters that are moveable between an open position and a closed position utilizing first and second pistons. In the open position, the first and second cutters permit fluid flow through the bore. In the closed position, at least one of the first and second cutters prevents fluid flow through the bore. First and second position rods are mechanically secured to the first and second cutters on opposite sides of the first and second pistons from the first and second cutters. The first and second position rods are connected to visual indicators that visually show whether the first and second cutters are in an open position or a closed position from a position external to the subsea pipe cutter. The locking mechanism comprises first and second locks that engage the first and second position rods to lock and unlock the first and second cutters in the closed position.

The sequence of operation comprises the steps of: for closing the subsea pipe cutter from the open position, the first and second locks being unlocked in the open position. The sequence of operation also includes applying hydraulic fluid to the first and second pistons to move the first and second cutters to the closed position. After the first and second cutters move to the closed position, then first and second valves direct hydraulic fluid to the first and second locks that engage the first and second position rods to lock the first and second cutters in the closed position. For opening the subsea pipe cutter when the first and second cutters are locked in the closed position, the sequence of operation also includes directing hydraulic fluid to the first and second locks to disengage from the first and second position rods so that the first and second locks are unlocked. After the first and second locks are unlocked, hydraulic fluid is applied to the first and second pistons to move the first and second cutters to the open position.

Implementations may include the sequence of operation further including the first and second position rods being mechanically linked to the first and second valves so that after the first and second cutters are in the closed position, then the first and second valves direct hydraulic fluid to the first and second locks that engage the first and second position rods to lock the first and second cutters in the closed position.

Another general aspect includes a locking mechanism for a subsea pipe cutter, comprising: a subsea pipe cutter housing; a cutter connected to a piston, the piston being responsive to hydraulic fluid to move the piston from an open position to a closed position, in the closed position the cutter shearing a pipe when a pipe is within the subsea pipe cutter; a position shaft rigidly connected to the piston, the position shaft extending outside a piston chamber outer wall of the subsea pipe cutter housing and being connected to a visual indicator that shows whether the cutter is in the open position or the closed position, the position shaft defining an opening; a piston rod connects to the piston and the cutter, the position shaft being connected to the piston on an opposite side of the piston from the piston rod; and a locking member for the position shaft, the locking member being positioned along the position shaft at a fixed distance with respect to the piston chamber outer wall, the locking member being moveable between a locked position and an unlocked position, in the unlocked position the locking member being outside the opening on the position shaft, when the cutter is in the closed position then the locking member is moveable to the locked position within the opening in the position shaft to fix the cutter in the closed position, the locking member being moveable to the unlocked position to permit movement of the cutter to the open position.

BRIEF DESCRIPTION OF THE DRAWINGS

The general description listed above and following detailed description is merely illustrative of the generic invention. Additional modes, advantages, and particulars of this invention will be readily suggested to those skilled in the art without departing from the spirit and scope of the invention. A more complete understanding of the invention and many of the attendant advantages thereto will be readily appreciated by reference to the following detailed description when considered in conjunction with the accompanying drawings, wherein like reference numerals refer to like parts and wherein.

DETAILED DESCRIPTION

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

Abbreviations include the following:

API—American Petroleum Institute

DNV—Det Norske Veritas (The Norwegian Veritas)

ISO—International Standardization Organization

ROV—remotely operated vehicle

NACE—National Association of Corrosion Engineers

QTC—Qualification Test Coupon

The use of CCD complies with codes and standards including:

API 6A, Specification for wellhead and Christmas tree equipment, 20th Edition, October 2010;

API 16A, Specification for Drill-through equipment, 3rd Edition, June 2004;

API 16D Control Systems for Drilling Well control Equipment, 2nd Edition, July 2004;

NORSOK D-002, Well intervention equipment, Revision 2, June 2013;

DNV-OS-E101, Drilling Plant, October 2013;

ISO 13533, Drilling and production equipment-Drill-through equipment, 1st Edition, December 2001;

API 17G, Recommended practice for completion/work-over risers, $2^{nd}$ Edition, July 2006

NACE MR0175/ISO 15156, Petroleum and natural gas industries—materials for use in H2S— containing environments in oil and gas production, 2nd Edition, October 2009.

Further details regarding a preferred embodiment of a compact cutting device used in the Dual compact cutting intervention system can be found in U.S. Pat. No. 9,732,576, which is incorporated by reference herein in its entirety.

Figure 3:
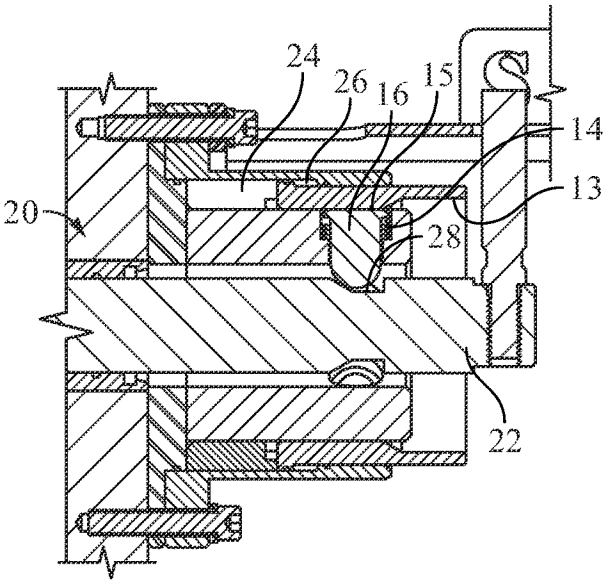
FIG. 3 is a side view, in section, of a CCD locking mechanism in the locked position in accord with one possible embodiment of the present invention.
Figure 2:
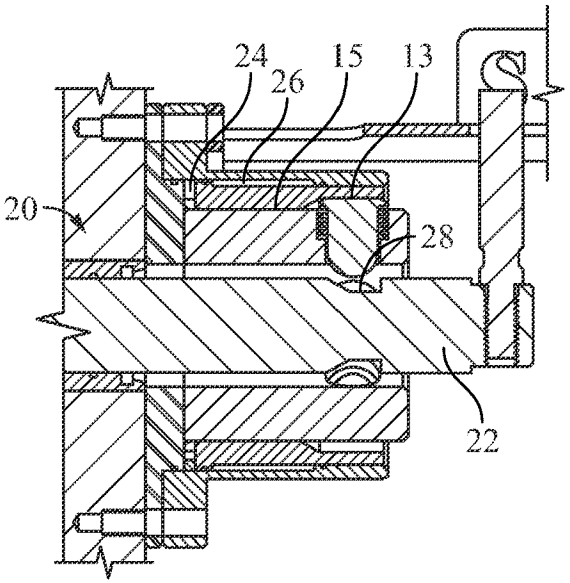
FIG. 2 is a side view, in section, of a CCD locking mechanism in the ready to lock position in accord with one possible embodiment of the present invention.
Figure 1:
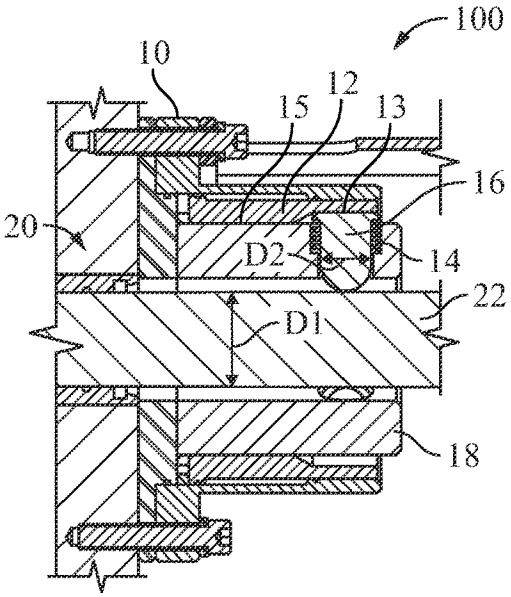
FIG. 1 is a side view, in section, of a CCD locking mechanism in the unlocked position in accord with one possible embodiment of the present invention.

Looking at FIGS. 1-3, and FIGS. 19B, 20B, and 21B, Locking Mechanism 100 works in combination with the main actuators of a Compact Cutting Device to lock and unlock the piston in a closed or open position automatically to avoid any system breakdowns. Essentially the same locking mechanism is utilized on both sides of the CCD so that only one side is described. The position shaft 22 is used to lock the piston in position. The position shaft 22 extends outside of the piston chamber outer wall 20 shown more generally in FIG. 21A. Piston chamber outer wall 20 forms the outermost side of the CCD housing 501. CCD housing 501 may also be referred to as a cutter housing as other types of cutters could utilize the locking mechanism 100 of the present invention such as rams or the like. Position shaft 22 is connected to piston 502. FIG. 1 shows the locking mechanism 100 of the CCD 500 position shaft 22 in the unlocked position. The wedge dog 16 is positioned along the position shaft 22 but outside of it. It will be appreciated that wedge dog 16 is at a fixed distance from piston chamber outer wall 20. The wedge dog 16, which may also be referred to as a locking element, remains at the fixed distance as seen in FIG. 1-3. FIG. 2 shows the locking mechanism wedge dog 16 aligned with machined groove or opening 28 in the position shaft 22 ready to be locked. The wedge dog 16 may also be referred to as a locking member or wedge that is insertable into the machined groove or opening 28 in each of the position rods 22 on either side of the CCD 500. In a presently preferred embodiment, the locking member 16 is insertable into a groove, opening, or the like formed on the position rod 22. The locking member 16 (wedge dog) on either side is in a fixed position with respect to the housing of the CCD 500 or piston chamber outer wall 20 and remains in that fixed position until opening or groove 28 on the position shaft 22 is moved into position directly adjacent to the locking member 16 as shown in FIG. 2. See also FIG. 19*a*-21*a*. Finally in FIG. 3, the locking mechanism 100 has been energized by pushing the locking piston collar 12 to push springs 14 and engage the wedge dogs 16 (locking member) in the machined grooves or opening 28 to lock the position shaft 22 in place.

It will be appreciated that the wedge dog 16 and machined groove 28 form a lock that prevents movement of the cutter in the closed position. This lock then locks the cutters in the closed position so that they no longer can be pushed open.

Collar 12 may also be referred to as a lock slider. Collar or lock slider 12 may be in surrounding relationship to position shaft 22. Collar or lock slider 12 is axially moveable within a specific range of movement with respect to the CCD 501 housing after CCD 501 is placed in the shut or closed position. The range of axial movement of the position shaft 22 is different than the range of movement of the collar or lock slider 12 but is along the same axis of movement. The collar or lock slider 12 has an internal profile or shape as shown with a recess 13 and a lock surface 15.

A position shaft is preferably used on both sides of CCD 500 so that the position of each cutter can be ascertained using an ROV. However, the position shaft 22 may be of a different length than position shaft 22*a* when a different stroke length is utilized. Also, the position shaft on each side is used as part of the locking mechanism for each cutter. However, the locking mechanism 100 is essentially the same. The two sides of the CCD 501 housing are shown in FIG. 19*a*, 19*b*, 20*a*, 20*b*, 21*a*, 21*b*.

The present invention is described for use in FIG. 19*a*, 19*b*, 20*a*, 20*b*, 21*a*, 20*b*, which is U.S. application Ser. No. 15/806,919 filed Nov. 8, 2017, which is incorporated herein by reference. A better understanding of CCD 500 is obtained with that description. It will be appreciated that CCD 500 uses the gates in different ways. While the gates move simultaneously from open to closed, and in the reversed direction, one gate has a shorter stroke length. However, the locking mechanism 100 can also be used with cutting mechanisms having the same stroke length for each cutter.

Figure 19A:
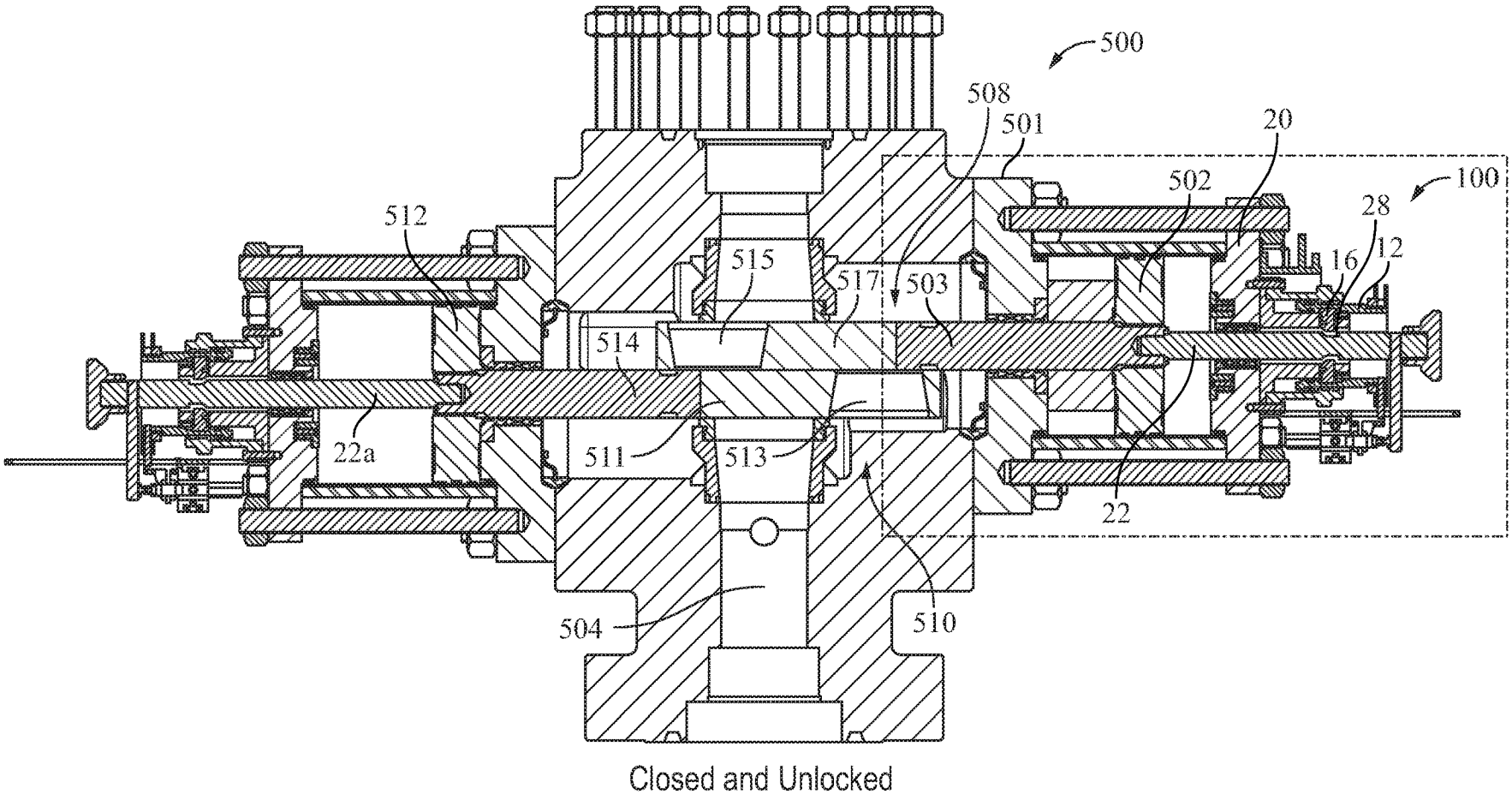
FIG. 19A is a side cross-sectional view of a dual CCD in the closed and unlocked position in accord with one possible embodiment of the present invention.

FIG. 19A shows CCD 500 closed and unlocked (ready to be locked). By closed it is meant that that if a pipe is present, then it would be cut as explained in U.S. application Ser. No. 15/806,919. By unlocked it is meant that the locking member 16 does not engage position shaft 22. Accordingly gates 508 and 510 are moved to the most inward position within CCD housing 501. Gates 508 and 510 are used for cutting pipe and may be referred to as cutters, cutting elements, or the like. Although gates 508 and 510 are not shear rams they do open, close the wellbore and cut any pipe in the wellbore like shear rams. They may also be referred to herein more generically as cutters or the like that are used to cut pipe in the wellbore and seal the wellbore after cutting. As shown in FIG. 19A, each gate comprises a blank portion and an opening. Gate 508 has an opening 515 and blank portion 517. Gate 510 has opening 513 and blank portion 511. FIGS. 20 and 21 refer more generally to gates 508 and 510.

In FIG. 19A, the CCD 500 is unlocked. As mentioned above, locking member 16 may be referred to as a wedge dog, dog, wedge or the like. Position shaft 22 is also sometimes referred to as a position indicating shaft because it is used to indicate the position of the cutter. The locking mechanism 100 is essentially the same on both sides and operates in the same way.

Figure 20A:
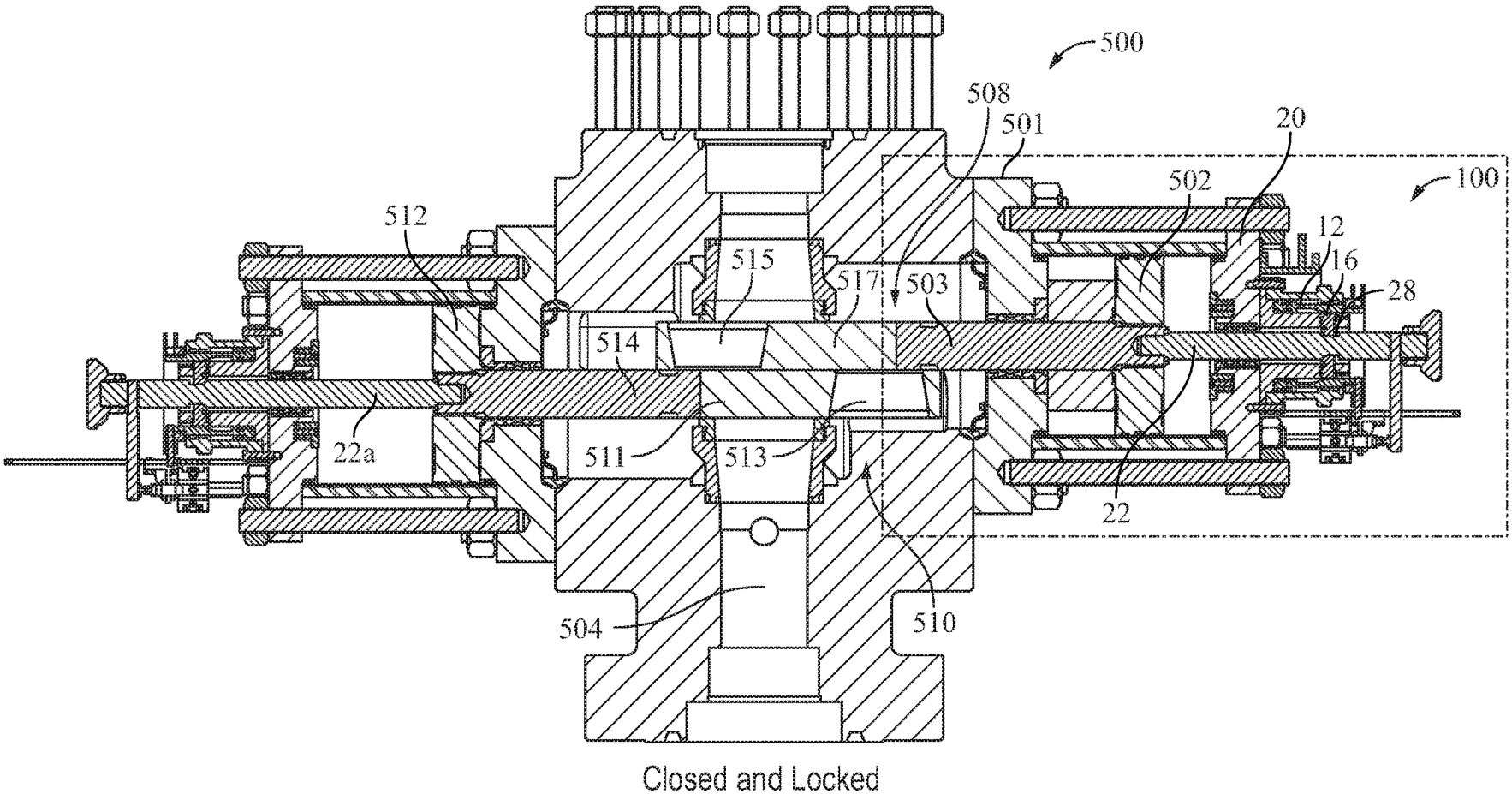
FIG. 20A is a side cross-sectional view of a dual CCD in the closed and locked position in accord with one possible embodiment of the present invention.

FIG. 20A shows the CCD 500 closed and locked. Dog 16 is engaged into the groove 28 in position shaft 22. In normal operation, the CCD 500 is always locked upon closing. The CCD 500 is unlocked prior to opening.

Figure 21A:
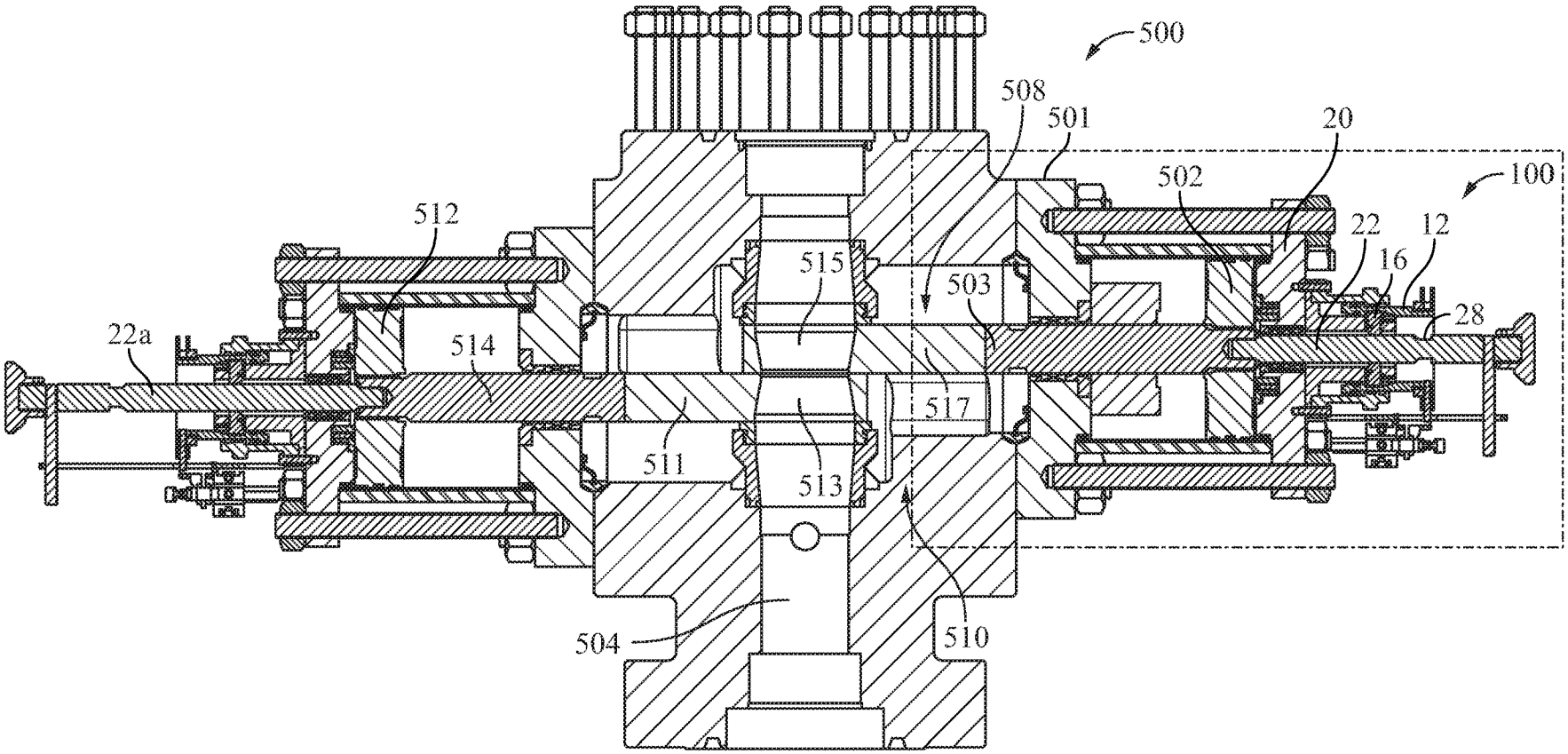
FIG. 21A is a side cross-sectional view of a dual CCD in the open and unlocked position in accord with one possible embodiment of the present invention.

FIG. 21A shows the CCD 500 open and unlocked. Gates 508 and 510 are moved to their outermost position away from bore 504. The locking member or dog 16 does not engage the groove 28. Groove 28 may be referred to as an opening, recess or the like.

Once closed, the CCD 500 is then locked. To open, the CCD must be unlocked first and then opened. The CCD 500 remains unlocked in the open position.

The position shaft 22 shown on the right hand side of CCD 500 is secured to and moves with the piston 502 of the CCD 500 where an external view of the position of the piston may be provided by a position indicator, whether it is locked, unlocked, or malfunctioning when in between the locked or unlocked positions. In other words, a portion of the position shaft 22 necessarily extends outside of the CCD housing 501 outermost piston chamber wall 20. Piston 502 operates the piston shaft, which may also be referred to as piston rod 503 that connects to upper gate 508. The CCD 500 is always unlocked in the open position. The CCD 500 preferably always locks after reaching the closed position as described hereinafter. The CCD must be unlocked before moving to the open position.

Corresponding piston 512 connects to piston rod 514 to operate gate 510. Because the stroke length of piston 512 is different from that of piston 502, the length of piston indicating shaft 22, also referred to as the position shaft or rod, is shorter than that of piston indicating shaft 22*a* on the opposite side of the CCD 500. The locking mechanism is the same on each side so that only locking of piston indicating shaft 22 is described. Gate 510 is used to seal off bore 504. Gate 508 is used to centralize pipe in bore 504 but does not seal the bore 504.

Referring back to FIG. 1, CCD locking mechanism 100 utilizes position shaft 22 for locking the CCD in the closed position. Position shaft 22 is operable to move laterally in an axis through CCD locking mechanism 100 within inner locking housing 18. Outer locking housing 10 contains inner locking housing 18. Outer locking housing 10 may contain fasteners such as bolts or the like that may retain CCD locking mechanism 100 secured to the CCD piston chamber outer wall 20. Between outer locking housing 10 and inner locking housing 18 is locking piston collar 12 which is responsive to changes in fluid pressure acting upon it. Locking piston collar 12 is configured to engage wedge dog (locking member) 16 such that as locking piston collar 12 traverses in an axis, it compels, engages, and/or energizes wedge dog 16 towards position shaft 22. Wedge dog 16 moves at right angles to position shaft 22. Wedge dog (locking member) 16 remains in a fixed position axially with respect to CCD 500 whereas position shaft 22 moves axially. Wedge dog 16 may also be referred to as a locking dog, dog, member or the like. In one possible embodiment, springs 14 push or urge wedge dog 16 to maintain an outward bias relative to position shaft 22 and are compressed as wedge dog 16 is urged or energized towards position shaft 22. In one embodiment, wedge dog 16 and the machined groove into which wedge dog 16 is inserted has a diameter D1 smaller than the diameter D2 of position shaft 22 so that wedge dog 16 fits entirely or substantially within position shaft 22.

Referring to FIG. 2, CCD locking mechanism 100 is in a ready to lock position in accord with one possible embodiment wherein wedge dogs 16 have not been fully urged into machined groove 28. In one possible embodiment, as fluid pressure is applied into locking chamber 24, locking piston collar 12 moves axially away from bore side 20 thereby decreasing the size of unlocking chamber 26. In other embodiments, locking piston collar 12 may move in another direction relative to piston chamber outer wall 20. Locking piston collar 12 comprises a recessed portion 13 with a tapered angled increasing in diameter when moving away from wedge dog 16 such that as locking piston collar 12 is urged towards wedge dog 16, wedge dog 16 begins to be compressed or urged further towards position shaft 22. Within position shaft 22 is machined groove 28 which may be a semi-circular, hemispherical, or any other desirable shape machined within position shaft 22 wherein there is a corresponding shape of wedge dog 16 on the engaging side of wedge dog 16 relative to position shaft 22. Groove 28 may be referred to as an opening or the like herein.

Referring to FIG. 3, CCD locking mechanism 100 is shown in the locked position in accord with one possible embodiment. Locking chamber 24 has been fully charged whereby fluid pressure has urged locking piston collar 12 to fully engage wedge dog (locking member) 16. Wedge dog 16 is pushed towards position shaft 22 compressing springs 14. When CCD 500 is closed, position shaft 22 machined groove 28 is aligned with wedge dog (locking member) 16. Wedge dog 16 locks position shaft 22 in position. In this way, CCD 500 is locked when in the closed position.

The reverse order is utilized to hydraulically unlock wedge dog 16. Wedge dog 16 is biased upward or away from position shaft 22 by springs 14. As fluid pressure is increased in unlocking chamber 26, locking piston collar or lock slider 12 is urged or slid towards bore side 20 thereby decreasing downward engagement between locking piston collar 12 and wedge dog 16. When locking piston collar 12 has substantially cleared wedge dog 16, wedge dogs 16 is disengaged from machined groove 28 by the upward bias of springs 14. This in turn unlocks position shaft 22 and allows it to be moved outward or away from bore side 20 and into the open position.

Figure 4:
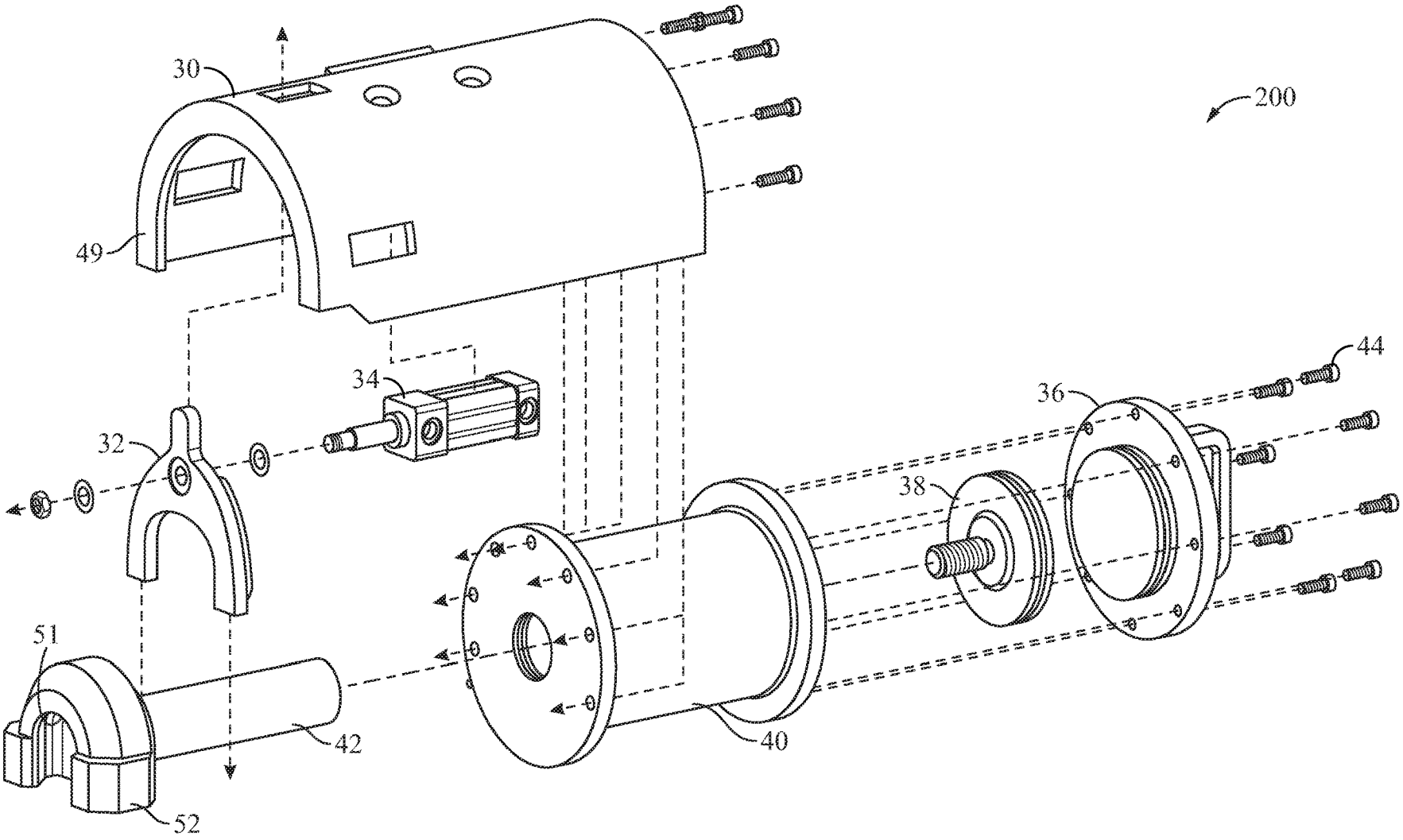
FIG. 4 is an exploded view, in perspective, of a CCD override tool in accord with one possible embodiment of the present invention.
Figure 5:
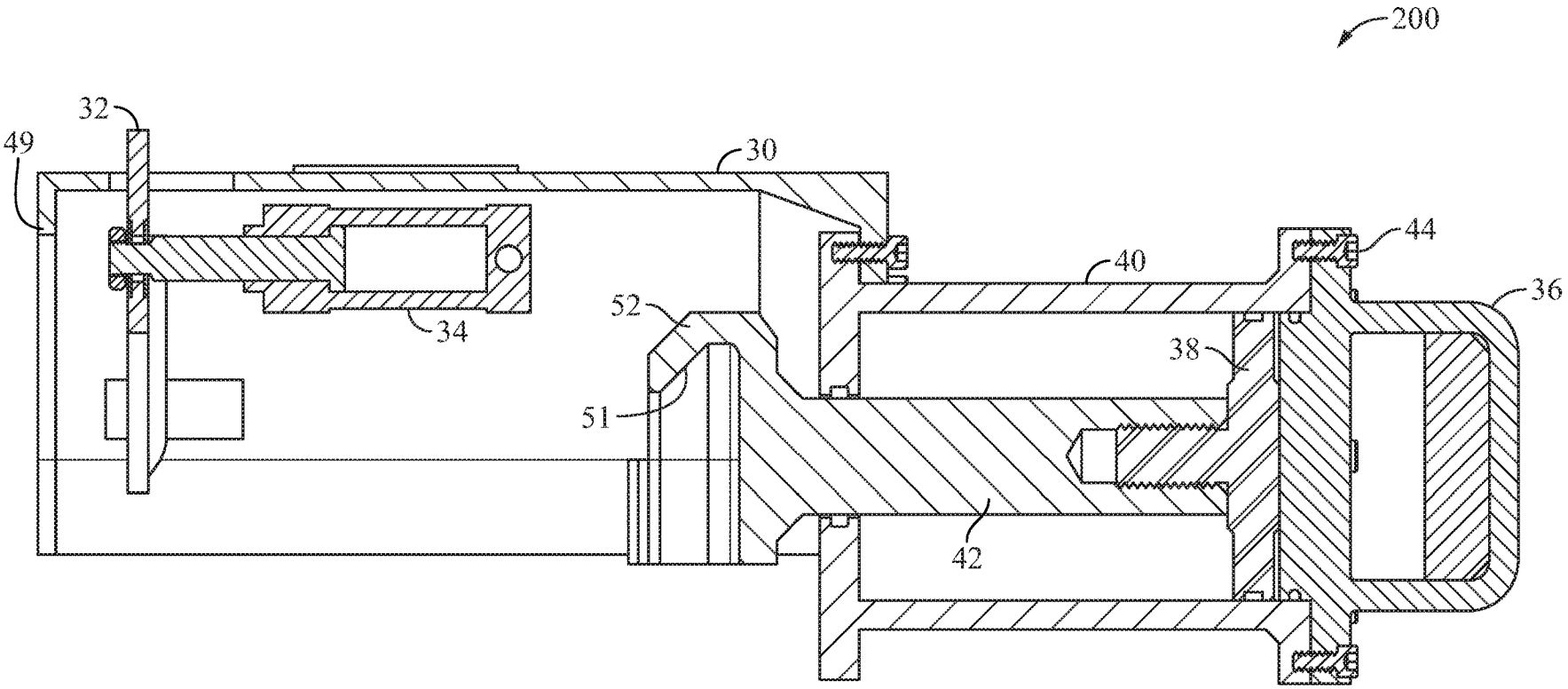
FIG. 5 is a side view, in section, of the assembled CCD override tool of FIG. 4 in accord with one possible embodiment of the present invention.

Referring now to a quite different feature, FIGS. 4-5 show the CCD Override Tool. The CCD Override tool is independent of the Compact Cutting Device and locking mechanism. In a preferred embodiment, the override tool 200 may weigh between 280-300 pounds and have a compact profile for ease of operation and portability. In one embodiment, the tool may have a length of less than 39 in. and a width of less than 14 in.

The CCD Override Tool may be used to override the current position of CCD 500. The CCD Override Tool may be carried into position by a remotely operated vehicle (ROV), which is used to interact with the CCD, typically after control is no longer otherwise available.

Referring to FIG. 4, an exploded view is shown, in perspective, of a CCD override tool 200 in accord with one possible embodiment of the present invention. Override tool (OT) guide pipe housing 30 mounts at the upper most portion of OT 200. OT housing 30 housing assists in properly orienting and guiding the OT to engage with the OT interfaces and may also be referred to as a guide pipe housing. (See. FIGS. 6-9). Lock adaptor 32 is mounted within OT housing 30 such that lock adaptor 32 may slide onto or interface with the lock slider collar 12 (see FIG. 8). Locking override cylinder 34 is secured by bolts or any other appropriate fastener to locking adapter 32. Locking override cylinder 34 is responsive to fluid pressure by extending or retracting which in turn may lock or unlock position shaft 22 as described above. OT interface coupler 52 may have a receptacle that can receive OT interface 48 (See FIGS. 6-7). Interface 48 may comprise an enlarged portion or knob. OT interface coupler 52 is attached or may be part of override tool piston rod 42 and piston head 38. Coupler 52 comprises an opening 51 that receives the enlarged portion 48 (See FIG. 8).

Figure 6:
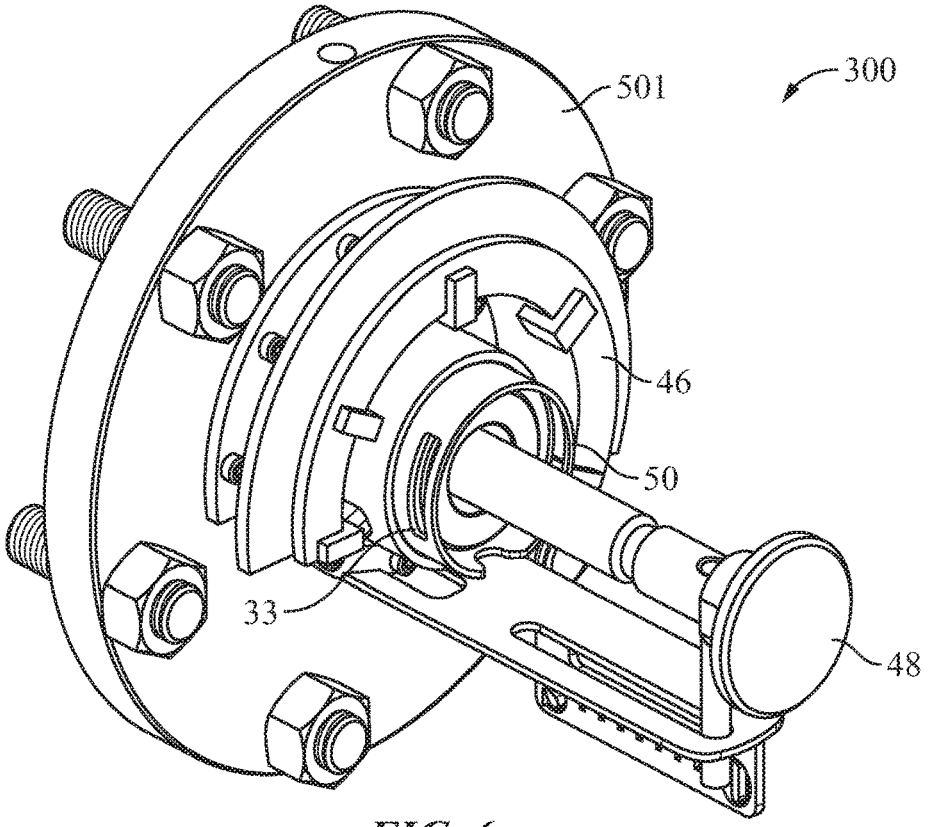
FIG. 6 is a perspective view of override tool interfaces in accord with one possible embodiment of the present invention.
Figure 8:
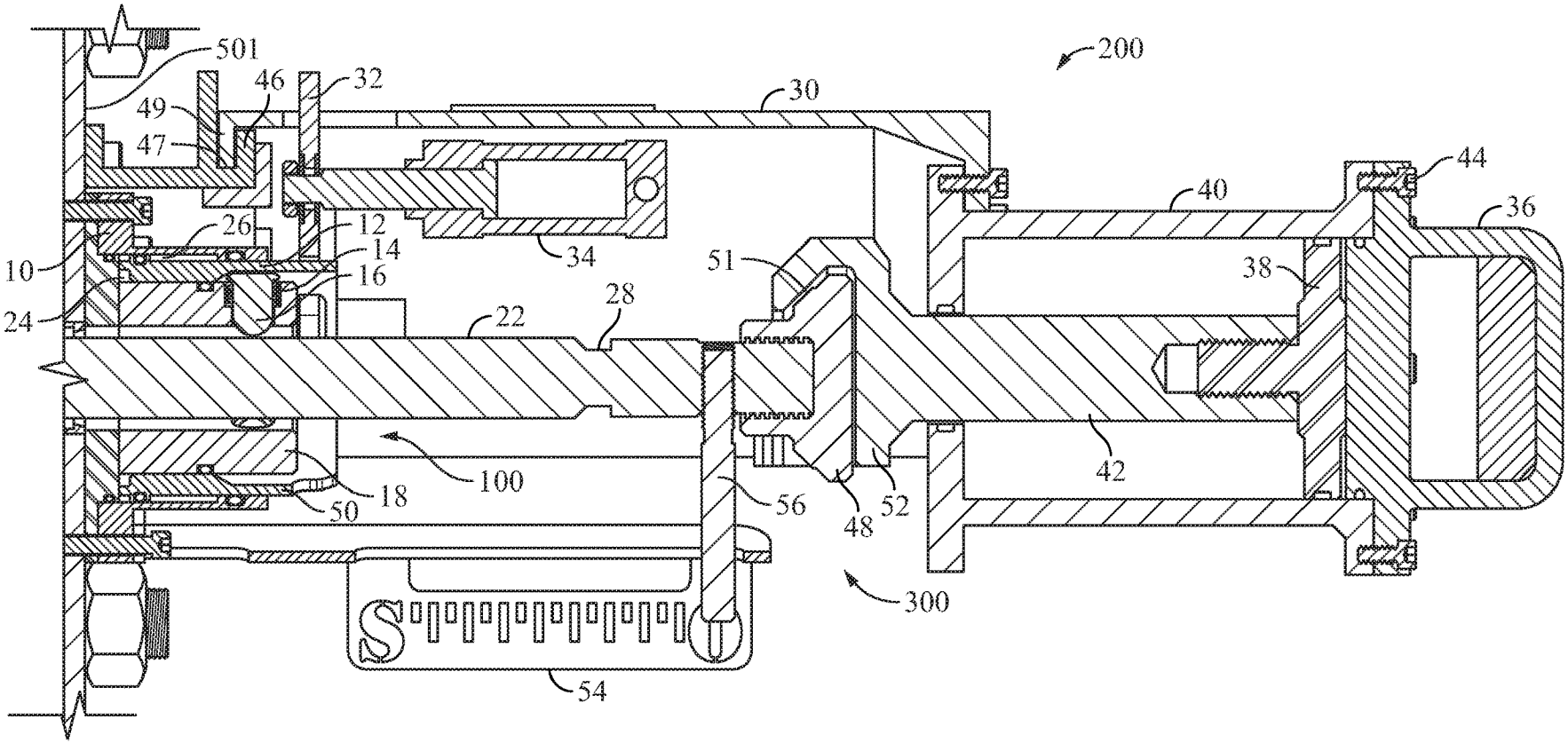
FIG. 8 is a side view, in section, of the mounted override tool in the open and unlocked position in accord with one possible embodiment of the present invention.

It will be appreciated that the override tool 200 may simply be lowered onto the three interfaces 47, 49 (to secure override tool housing 30 to CCD housing 500) and 48, 51 (secure override tool piston rod 42 to position shaft 22) and 32, 12 (see also slot 33 in FIG. 6). FIG. 8 best illustrates each interface when OT 200 is mounted.

Override tool Piston rod 42 may move in an axis through override tool cylinder 40. As fluid pressure is increased on the outer portion of piston head 38, then piston head 38, piston rod 42, and OT interface coupler 52 are urged closer to bore side 20 which is the closed position. Fluid and pressure are retained within OT cylinder 40 by cylinder cap 36 which may be secured through bolts 44 or like means.

Turning to FIG. 5, a side view, in section, is shown of the assembled CCD override tool 200 of FIG. 4 in accord with one possible embodiment of the present invention. It can be more clearly seen that override locking adapter 32 and locking override cylinder 34 are mounted to OT housing 30 closer to the locking mechanism relative OT interface coupler 52, piston rod 42, and piston head 38. OT housing 30 may be constructed in a semicircular or arched configuration to allow movement of OT interface within OT guide pipe's structure. OT housing 30 may be secured at the outermost end to OT cylinder 40 so that OT cylinder 40 protrudes outwardly.

Figure 7:
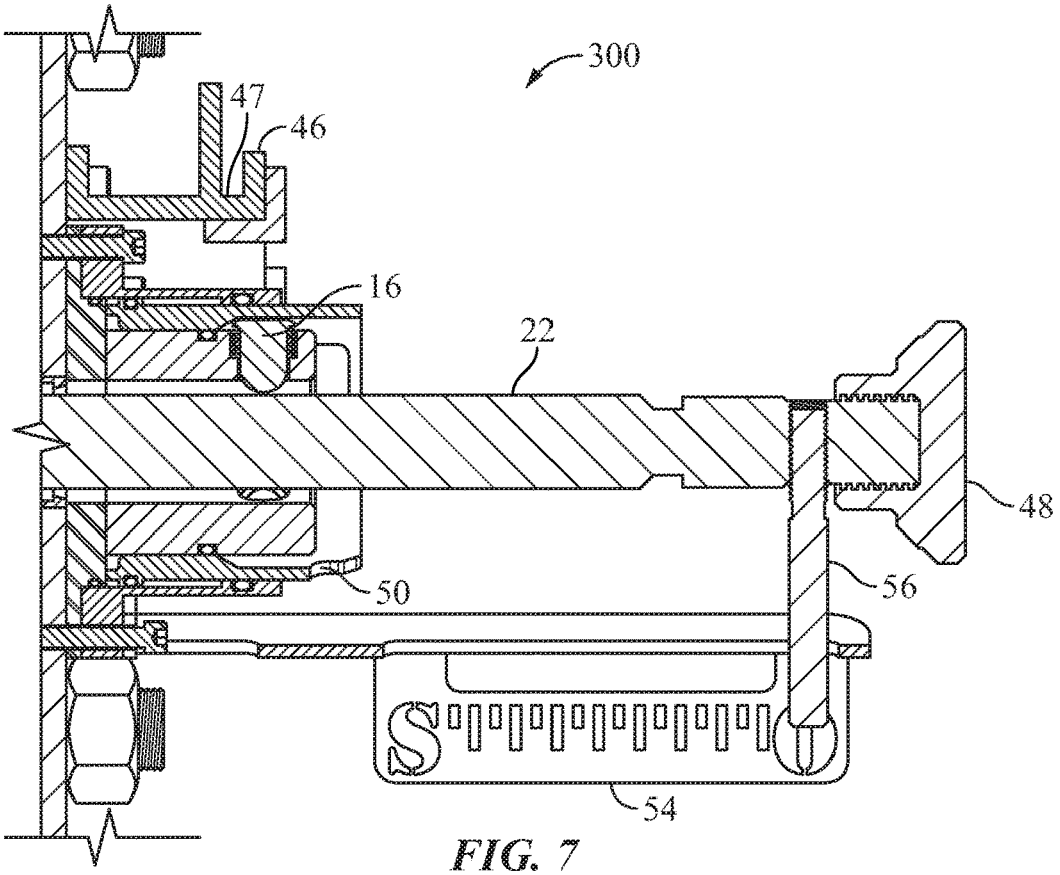
FIG. 7 is a side view, in section, of override tool interfaces in accord with one possible embodiment of the present invention.

FIGS. 6-7 depicts the interfaces on the override tool interface assembly 300 of CCD 500 (see also FIG. 20A) which engage the CCD Override Tool 200 during operation and where the CCD Override tool 200 is installed or otherwise secured on the override tool interface assembly 300. Override tool 200 attaches to CCD housing. More generally, the CCD housing 500 may be referred to as a pipe cutter housing because the invention could be utilized with other types of pipe cutters. The interfaces are formed on the CCD housing as shown to allow connection to the override tool 200 when it is necessary to do so. For example, if the CCD is open and it is desired to close the CCD to stop fluid flow out of the CCD. The override tool may be carried by the ROV tool to operate CCD 500.

Figure 9:
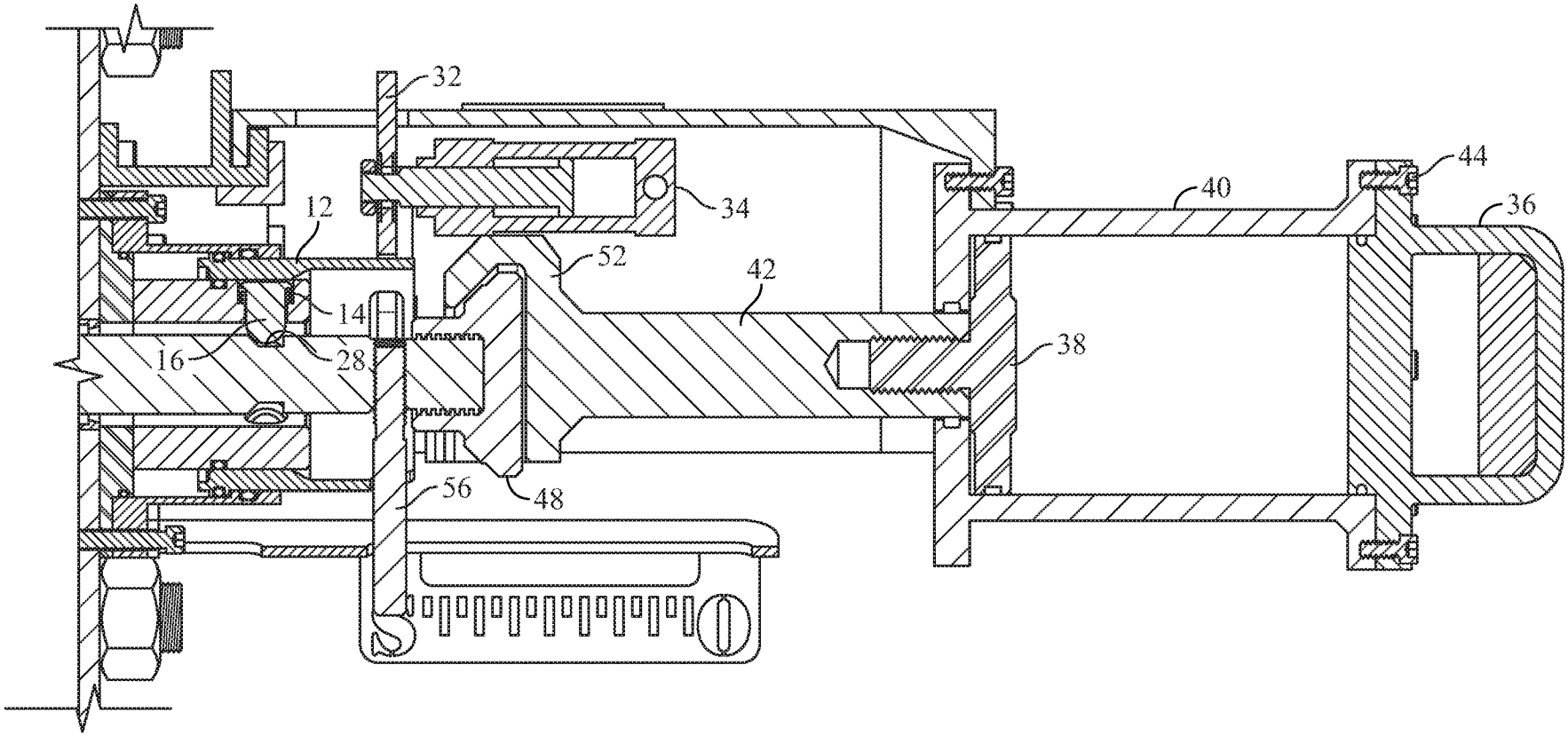
FIG. 9 is a side view, in section, of the mounted override tool in the closed and locked position in accord with one possible embodiment of the present invention.

FIG. 8-9 show the override tool 200 installed onto CCD housing.

Figure 10:
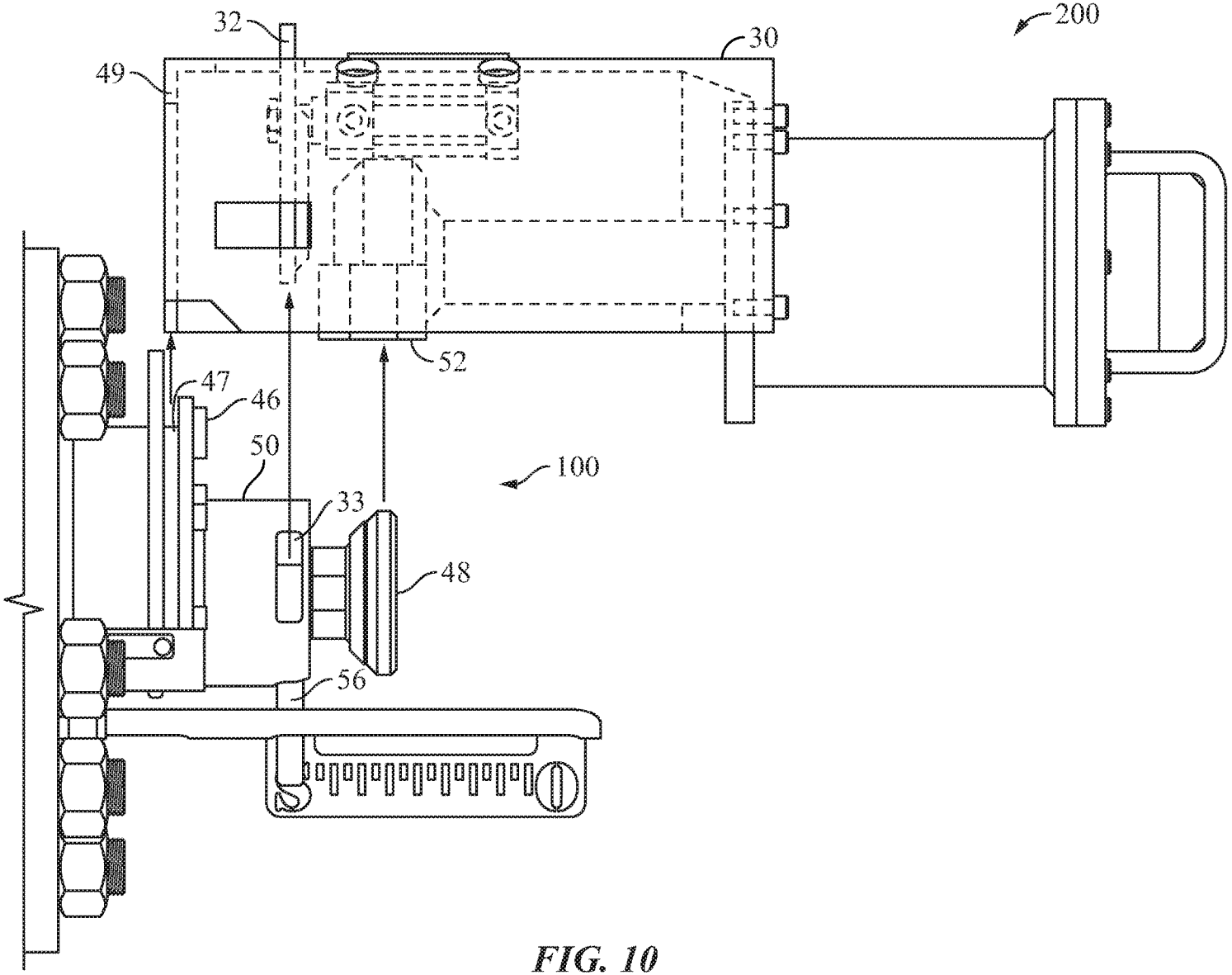
FIG. 10 is a side view of the override tool being disengaged from the CCD locking mechanism after the CCD has been moved to the closed and locked position in accord with one possible embodiment of the present invention.

FIG. 10 shows the override tool being removed from CCD housing.

Referring to FIG. 6, a perspective view is shown of override tool interface assembly 300 in accord with one possible embodiment of the present invention. In one embodiment, OT interface 48 may comprise a round circular knob with a flat end which may interface with OT interface coupler 52. OT interface 48 is on an outer end of position shaft 22. Locking collar interaction 50 is on the outer end of inner locking housing 18 and surrounds the inner housing. Locking collar interaction 50 may have an opening or slot to accept locking adapter 32. OT reaction pipe 46 is secured to the outer end of CCD by suitable means such as bolts or the like. OT reaction pipe 46 may have an opening or slot 47 to accept a lip 49 of OT housing 30 thereby properly orienting override tool 200 onto CCD locking mechanism 100. The insertion or engagement of lip 49 into slot 47 is an interface that prevents axial movement of OT housing 30. OT pipe housing 30 may also be referred to as an override tool housing 30. It is relatively easy to insert lip 49 into slot 47. Slot 47 is connectable to lip 49, which may be also be referred to as a housing connector of the OT housing 30, to secure the cylinder from axial movement with respect to the pipe cutter housing.

In one possible embodiment, therefore override tool 200 may be secured in just three locations allowing for a quick yet secure attachment to override tool interface assembly 300. These interfaces may be summarized as: (1) lip 49 (of OT housing 30 also referred to as a housing connector) into slot 47 (of OT reaction pipe 46); (2) locking adapter 32 onto locking collar 50 (with slot 33); and (3) OT coupler interface 52 (with opening 51) onto OT interface 48. This embodiment provides quickly deployable and retrievable mounting points for an ROV to secure/retrieve override tool 200. Other possible embodiments may utilize greater or less than three mounting points and may be secured in other ways.

Referring to FIG. 7, a side view, in section, is shown of override tool interface assembly 300 in accord with one possible embodiment of the present invention. OT interface 48 is shown in the open position in which position shaft 22 is fully extended outward from the CCD. The position of the gate or ram is indicated by position scale 54 and position indicator 56. "O" is the open position and "S" is the shut or closed position. The override tool (OT) may be used to either open or close the CCD. Any position between these two on scale 54 indicates a potential failure of the CCD which may be correctable using the override tool. For example, hydraulic power may have been lost so that use of the override tool restores operation. It will be seen that the position shaft 22 is connected to a position indicator that moves with the position rod on the position scale to indicate open and closed (shut) positions of each actuator. Accordingly the position shaft 22 is connected to visual indicators or indications 56 and 54 on each side of the CCD.

Position indicator 56 is adjacent OT interface 48 and moves laterally with movement of position shaft 22. In the open position, position indicator 56 is at the outermost position and may be positioned on the position scale at the O position. As the position shaft 22 is urged towards the closed position, position indicator 56 likewise is urged to indicate the current position. In the closed position, position indicator 56 may be at the innermost position at the S position indicating that the gate or ram is shut. This may be helpful to assist a user to visually inspect the current position status of the Override tool 200 and the gates. Other markings may be used to indicate the position, as well as non-mechanical means such as electronically or the like. Interface 48 may be a flat circular protrusion or knob at the terminal end of position shaft 22. Other shapes may also be used as desired such that OT interface 48 is operable to engage OT interface coupler 52. OT reaction pipe 46 may be secured to the CCD by bolts or other like means. OT reaction pipe 46 protrudes outwardly from the CCD with a slot 47 operable to engage a corresponding flange or lip 49 on OT housing 30. Locking collar 50 surrounds position shaft 22 and may comprise a slot operable to engage locking adapter 32. In the unlocked and open position as shown, wedge dog 16 is recessed within inner locking housing 18. When position shaft 22 is moved to the closed position, wedge dog 16 may then be extended downward into machined groove 28 within position shaft 22 thereby locking position shaft 22 in place.

FIGS. 8-9 show the operation of the CCD Override tool, having been placed in position, being used to move the CCD from the open position to the closed position. In this way, the throughbore 504 through the CCD 500 may be closed even after hydraulic fluid power is lost for operating the CCD. Referring to FIG. 8, a side view, in section, is shown of the mounted override tool 200 in the open and unlocked position in accord with one possible embodiment of the present invention. Pressure is applied to the external side of override tool cylinder 40 to push the position shaft 22, and in turn the stem and/or gate, in towards the closed position. Pressure is applied to the external side of piston head 38 between cylinder cap 36. Cylinder cap 36 retains the fluid within the cylinder and may be secured to OT cylinder 40 by bolts 44 or other like means. As the pressure is increased, piston head 38 is urged inward which in turn moves piston rod 42 inwards. At the end of piston rod 42 is OT interface coupler 52 at the outermost end of OT interface assembly 300. OT interface coupler 52 comprises a recessed portion or opening 51 able to accept OT interface 48. OT interface 48 is mounted at the outermost end of position shaft 22. Therefore, as piston rod 42 moves inward, this moves OT interface coupler 52 which is engaged to OT interface 48 and also position shaft 22 which in turn moves the gate to the closed position.

The current position of the gate is indicated by position indicator 56 marking the corresponding position on position scale 54. As shown, the gate is in the open position. In the open position, wedge dog 16 is in the retracted position and not engaging machined groove 28. In one embodiment, locking override cylinder 34 is mounted to inner side of OT housing 30. Locking adapter 32 is in the extended position whereby locking override cylinder 34 is fully extended. Locking adapter 32 engages a slot 33 within locking collar 50 (See FIG. 6). Locking collar 50 comprises locking piston collar 12. The locking piston collar 12 in the unlocked position is extended inward where wedge dog 16 is not in engagement or urged downwards.

Referring to FIG. 9, a side view, in section, is shown of the mounted override tool 200 in the closed and locked position in accord with one possible embodiment of the present invention. As the piston rod 42 is extended and position shaft 22 is fully moved inward, pressure can then be applied into locking override cylinder 34 which will pull locking adapter 32 and locking piston collar 12. Pressure is applied to the retract port of locking cylinder 34 on the inner side of the piston. As the pressure increases, the locking adapter 32 pulls the locking piston collar 12 over wedge dogs 16 causing them to push inwards or downward into machined groove 28 thereby locking position shaft 22 in place in the closed position. Utilizing wedge dogs 16 in such a way ensures pressure within the CCD or wellbore does not push the gate or position rod open inadvertently. This increases reliability and safety during operation.

Referring to FIG. 10, a side view is shown of the override tool 200 being disengaged from the CCD locking mechanism 100 after the CCD has been moved to the closed and locked position. Once the OT tool 200 has successfully positioned the gate in the closed position and locked it in place, override tool 200 may be disengaged from CCD locking mechanism 100 by raising or lifting override tool 200 away from the locking mechanism 200 such that the flange or lip 49 on OT housing 30 disengages from the slot 47 within in OT reaction pipe 46, locking adapter 32 disengages the slot within locking collar interaction 50, and OT interface coupler 52 disengages from OT interface 48. The override tool 200 may then be removed and brought to the surface or in another embodiment be mounted with an ROV. Divers or Remotely (not shown) operated vehicles are well known to operate tools for use with subsea equipment.

The reverse operation may be used to unlock and open the gate. Override tool 200 may be lowered or mounted onto CCD locking mechanism 100. In this embodiment, OT piston rod 42 is fully extended and locking override cylinder 34 is fully retracted. This will ensure the correct position for each component to properly engage the corresponding part on the respective override tool 200 and locking mechanism 100. After override tool 200 is mounted, pressure may be supplied to locking cylinder 34 to extend the rod inward. This will, in turn, push locking adapter 32 and the collar piston 12 inward thereby disengaging the wedge dogs 16 and unlocking position shaft 22. In this embodiment, the locking mechanism 100 is first placed in the unlocked position prior to opening or extending the position shaft 22. With the piston collar 12 retracted, the springs 14 will push the wedge dog 16 upwards or outwards relative to position shaft 22 releasing position shaft 22 from being locked. With the dogs 16 in the unlocked position, pressure may now be applied to the OT cylinder 40 on the inner face of piston head 38. This will pull position shaft 22 along with the stem/gate to the open position. Once the override tool 200 has fully retracted position shaft 22 along with the stem/gate, the CCD is now unlocked and in the open position. Override tool 200 can then be recovered as discussed above.

Figure 11:
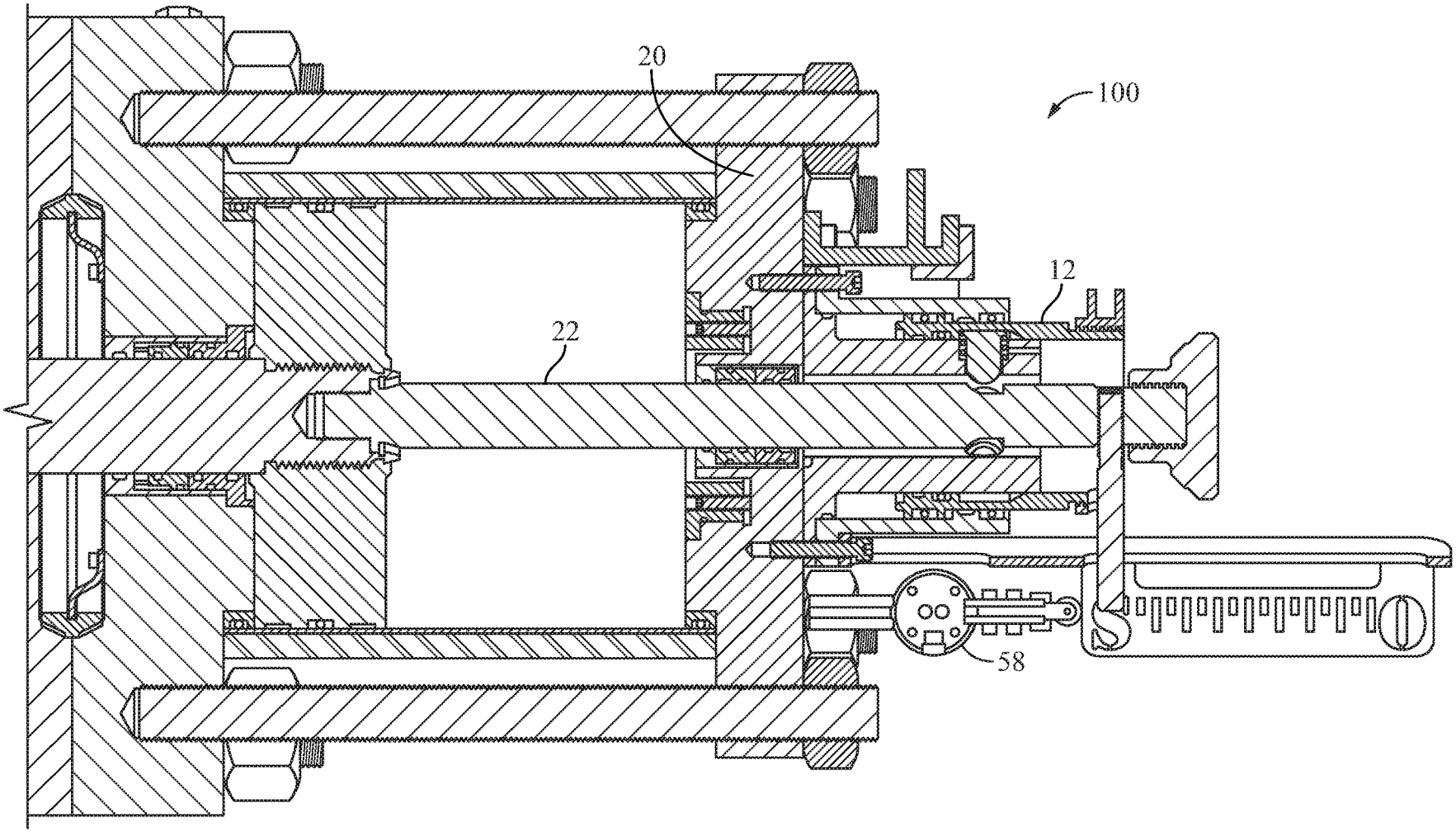
FIG. 11 is side view of CCD locking mechanism in the closed and unlocked position wherein a valve is mounted to control fluid flow to open and close the gate in accord with one possible embodiment of the present invention.

One of the main ideas of the present invention is that mechanically operated valves will be engaged by the moving parts of the system as shown in FIGS. 11-18 and 22-25. This embodiment shows operation of CCD 500 during normal operation—i.e., without the override tool 200. More generally CCD 500 may be referred to as a cutter housing because other types of cutter housings could utilize the present invention. One configuration for the present invention is shown in FIG. 11. In one possible embodiment, the position rod will physically come in contact and actuate 4-way/2-position cam valve 58 (see FIG. 13). The collar piston on the locking mechanism will physically actuate a 2-way ball valve. There will be 4 lines coming from the topside; 2 for pressure and 2 for the pilot signals to operate the locking mechanism. However, other valves may be used or combinations of various valves may be used as well.

When referencing the diagrams, if the lever 59 is up on the 4-way/2-position valve, the circuit is parallel through the bores. If the lever 59 is down on the 4-way/2-position valve, the circuit is switched through the bores. If the Ball valve lever 75 is to the right with a clear circle, then the ball valve 74 is open. If the Ball valve lever 75 is to the left with a crossed through circle, then the ball valve 74 is closed.

Referring to FIG. 11, one possible embodiment is shown with a 4 way/2 position cam valve 58, which may also be referred to as a 4 way/2 position valve, 4/2 cam valve, 4/2 valve, valve or the like, mounted to the CCD below locking mechanism 100. The valve 58 could be implemented in different ways, with multiple valves or the like. In this embodiment as shown, collar piston 12 is not engaging wedge dog 16 therefore wedge dog 16 is retracted or pushed upward away from position shaft 22. This is the unlocked position. Position shaft 22 is fully extended inward in the closed position. While wedge dog 16 is not engaged, it is in the correct position to be engaged to lock CCD 500 in the shut position.

Figure 12:
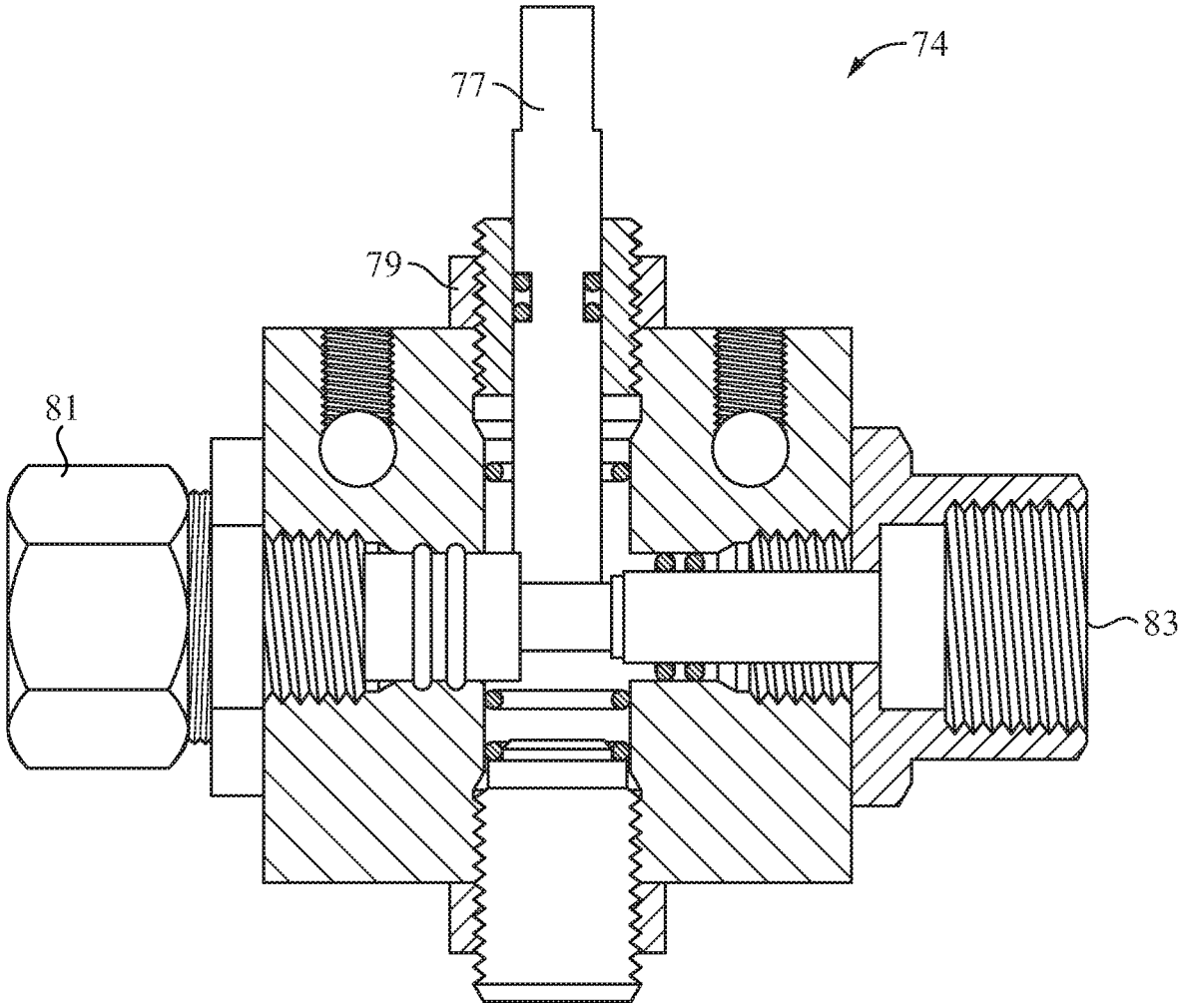
FIG. 12 is a partial cross-sectional view of a valve used to control fluid flow to open and close the gate in accord with one possible embodiment of the present invention.

One non-limiting example of a ball valve 74 used in the presently preferred embodiment is shown in FIG. 12. The valve may be a 2-way subsea series valve with a 1" orifice capable of pressure to 10,000 psi or 690 bar. The valve may comprise a ball stem 77 extending into the valve through a packing gland and O-ring. A Locking piece 79 may lock the piece ball stem in the valve by tightening into position around the ball stem. The stem 77 is utilized to control flow through the ball valve 74 between the flow openings 81 and 83 in a standard manner for ball valves. Various types of ball valves may be utilized. Ball valve 74 is shown mounted in position in FIG. 22-24 except for hydraulic lines that are secured to openings 81 and 83.

FIG. 13-18 show the hydraulic system that is used to implement the sequence of operation of the present invention for closing, locking, unlocking and opening of the CCD 500. CCD 500 remains unlocked when in the open position. Only when the cutters 508 and 510 are in the fully closed position are they locked in position. In this way, internal pressure inside CCD 500 cannot push the cutters 508 and 510 open when hydraulic pressure is reduced or lost. The cutters 508 and 510 are unlocked before they are opened.

Figure 13:
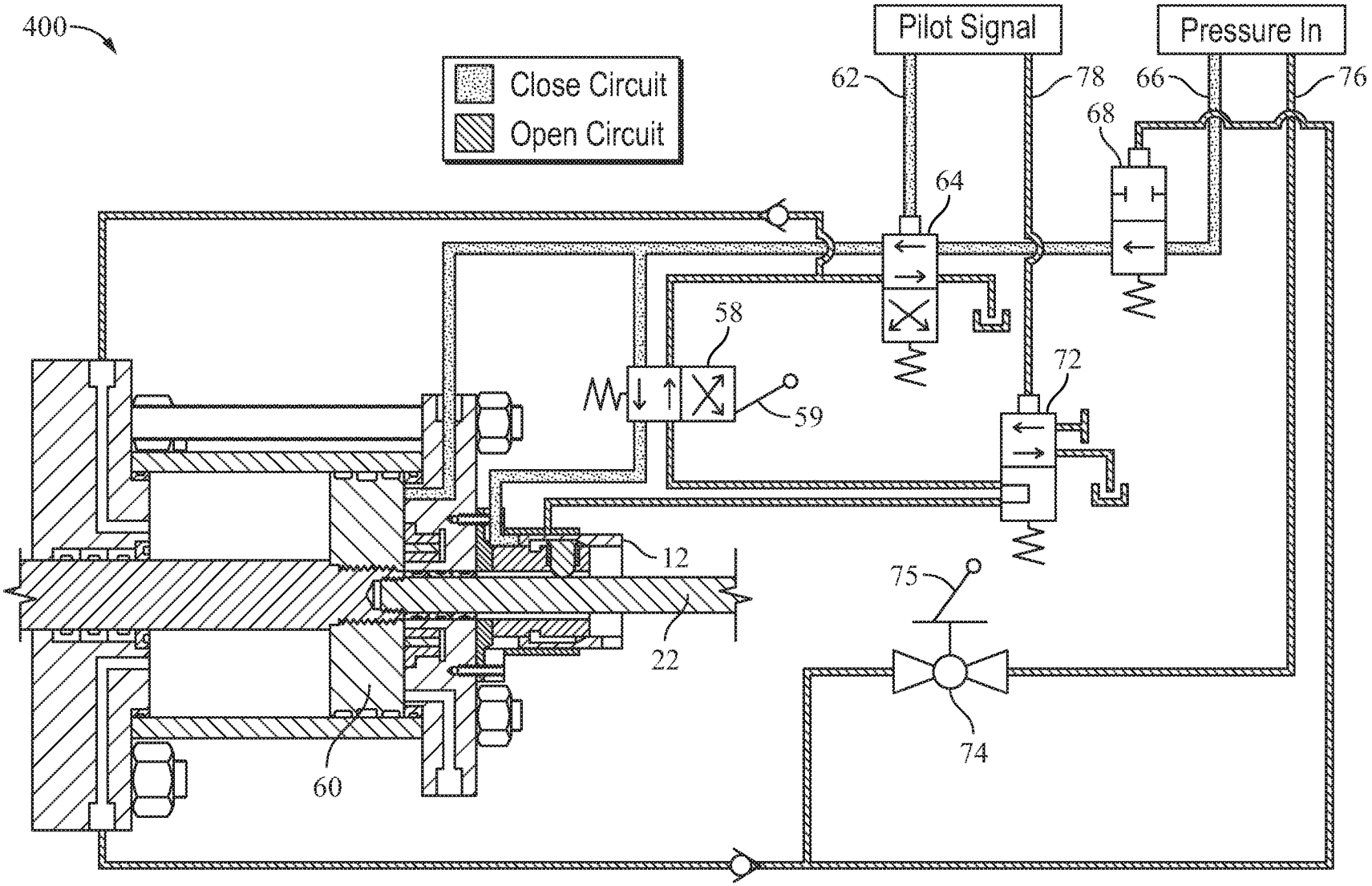
FIG. 13 is a diagrammatic view of the valve system in the closed and unlocked position in accord with one possible embodiment of the present invention.

Referring to FIG. 13, a diagrammatic view of valve system 400 is shown in the closed and unlocked position. To close the actuator, pressure is applied to line 62 which will pilot valve 64 as shown in FIG. 13. Pressure is then applied to line 66. This fluid drives the piston 60 from open to close and moves the Collar Piston 12 to unlock.

Figure 14:
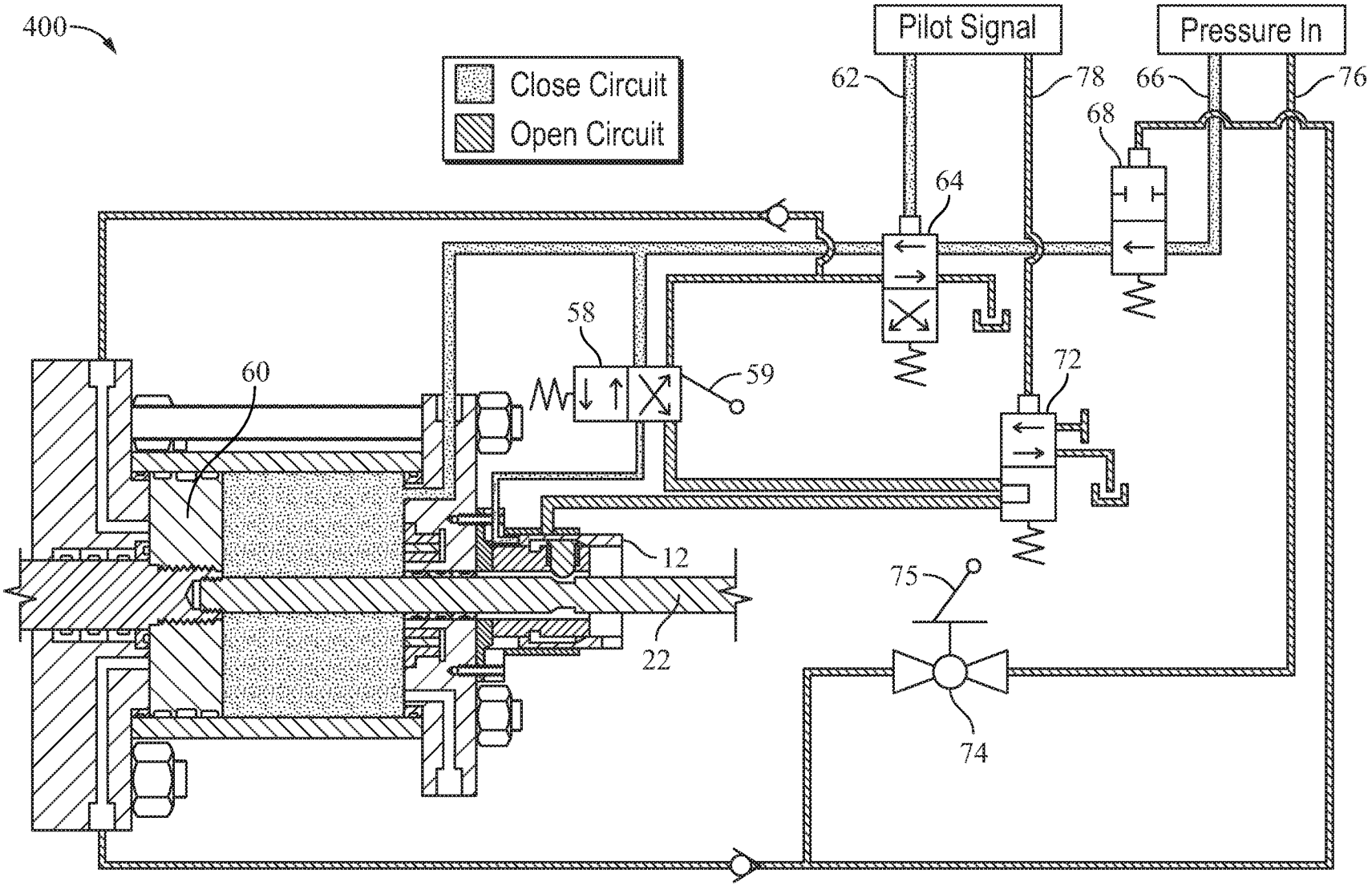
FIG. 14 is a diagrammatic view of the valve system in the closed and locked position in accord with one possible embodiment of the present invention.

Turning now to FIG. 14, the CCD locking mechanism is shown locking after being in a closed position. When the position shaft 22 ends its stroke, it will mechanically actuate the Cam Valve 58, switching the direction of pressure into the lock side of the Collar Piston 12. Position indicator 56 engages 4 way valve switch lever 59. Switch lever 59, which may also be called valve switch 59, changes the flow direction of hydraulic fluid after being hit by position indicator 56 (See FIGS. 22-23).

Figure 15:
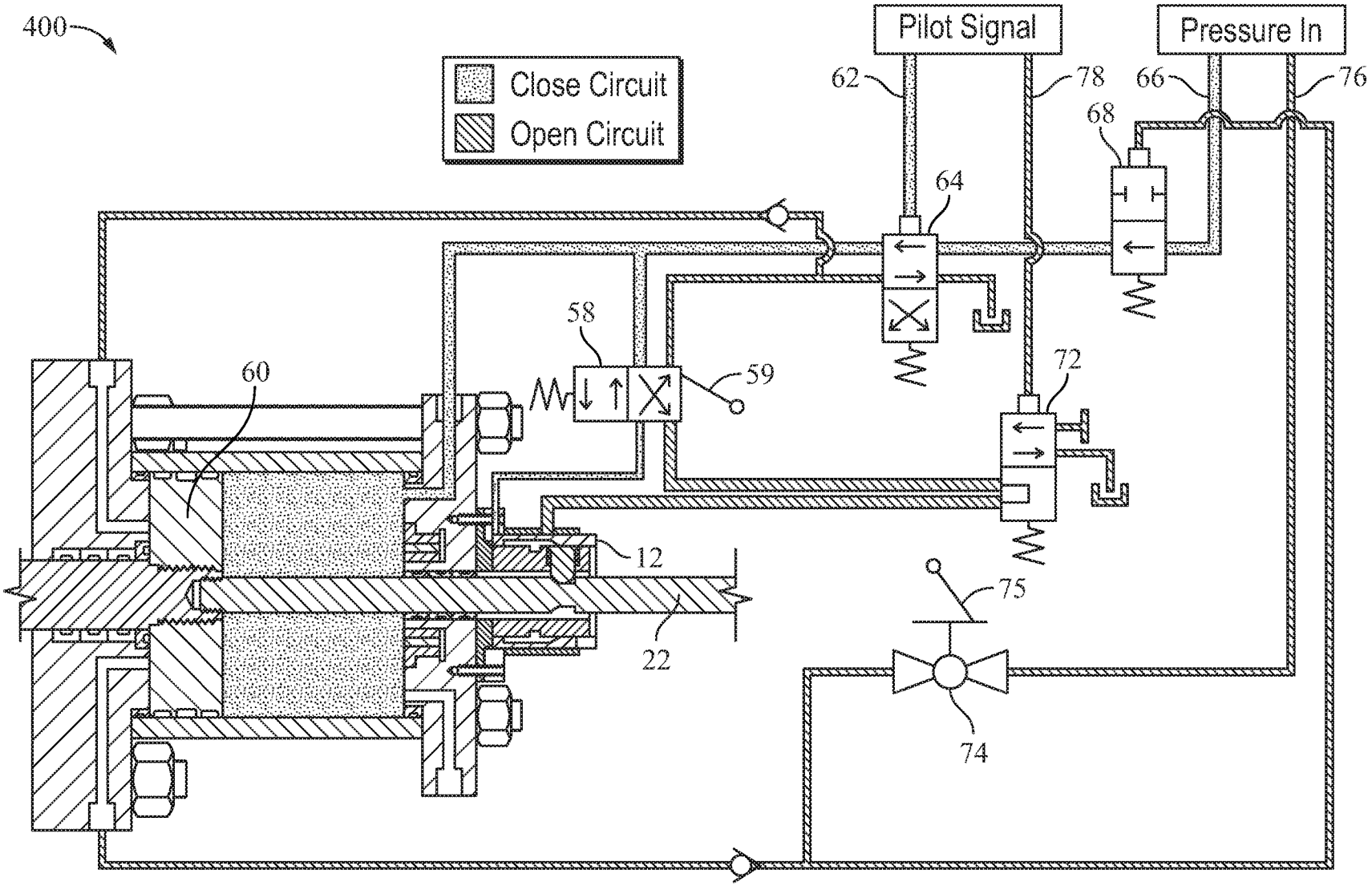
FIG. 15 is a diagrammatic view of the valve system in the closed and locked position in accord with one possible embodiment of the present invention.

In FIG. 15, the Collar Piston 12 is not locked and the Ball Valve 74 is closed.

Figure 16:
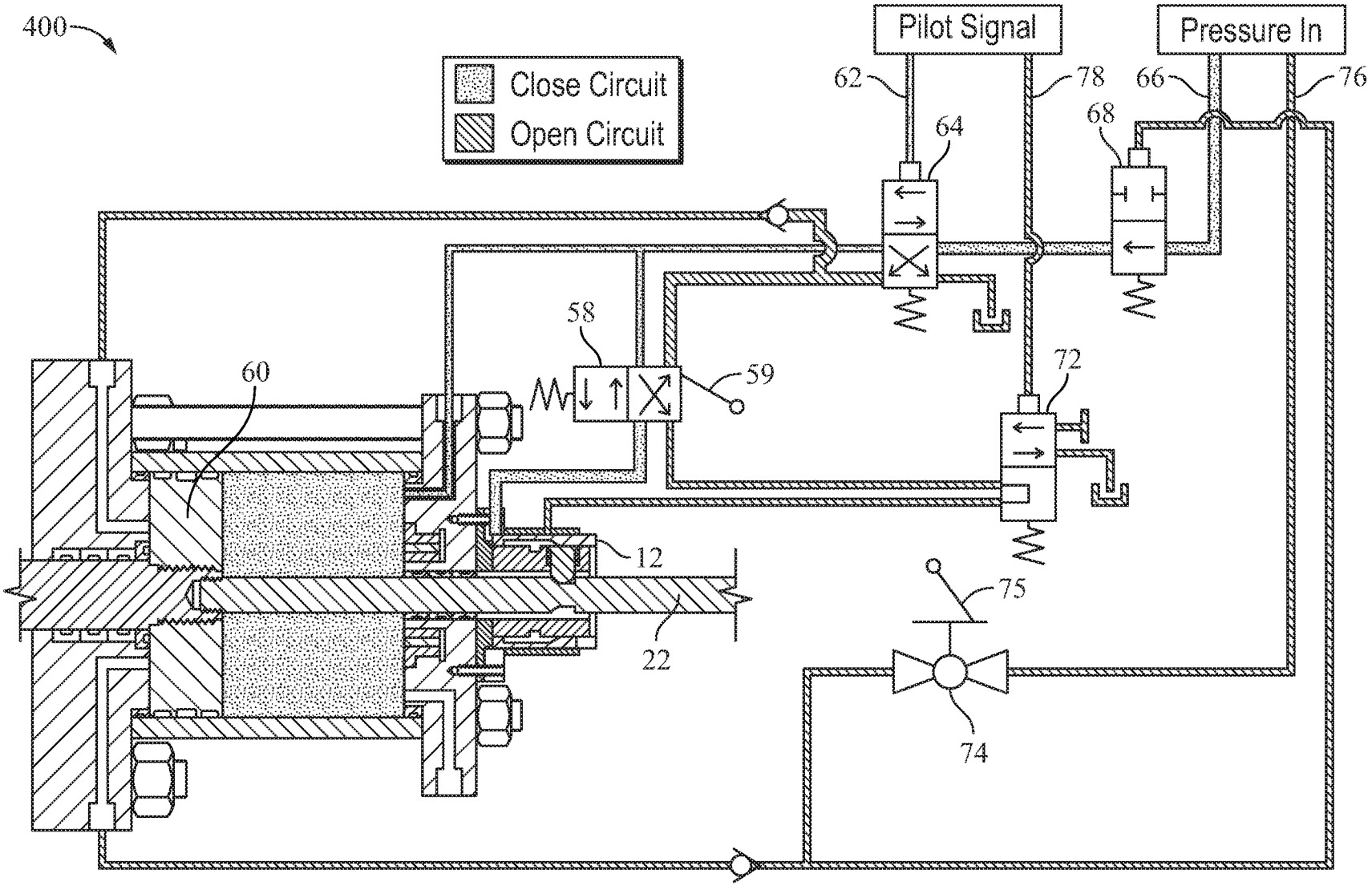
FIG. 16 is a diagrammatic view of the valve system in the closed and locked position moving to the unlocked position in accord with one possible embodiment of the present invention.
Figure 17:
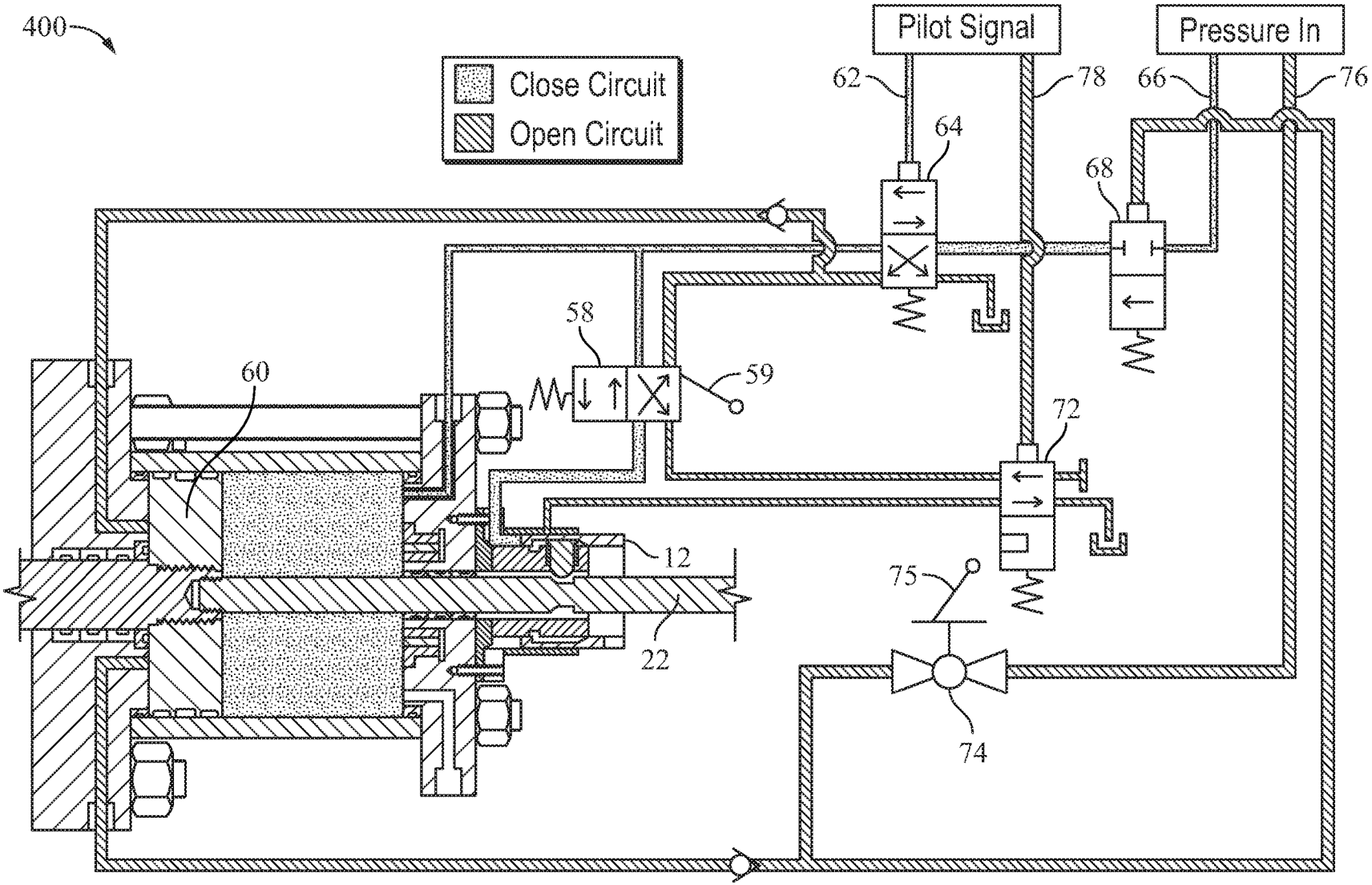
FIG. 17 is a diagrammatic view of the valve system in the closed and unlocked position moving to the open position in accord with one possible embodiment of the present invention.

Looking to FIG. 16, the pilot signal is released from line 62 and valve 64 shifts to its original crossed-line orientation. The pressure from line 66 is now shifted to the unlock side of the Collar Piston 12. Note valve 58 has remained in the same orientation. In FIG. 17, the Collar Piston 12 has physically moved Ball Valve 74 to the open position. The collar piston to ball valve switch lever 75, which may also be called valve switch 75—changes direction in response to movement of the collar piston 12 (See FIGS. 24-25). Pressure can now be applied to pilot line 78 and pressure line 76. Pilot line 78 will shift Valve 72 to the through bore position. With Ball Valve 74 open, Valve 68 is now piloted and cuts off flow from topside pressure line 66. Fluid is now introduced into the open side of the Piston 60 and continues to pressure the unlock side of Collar Piston 12.

Figure 18:
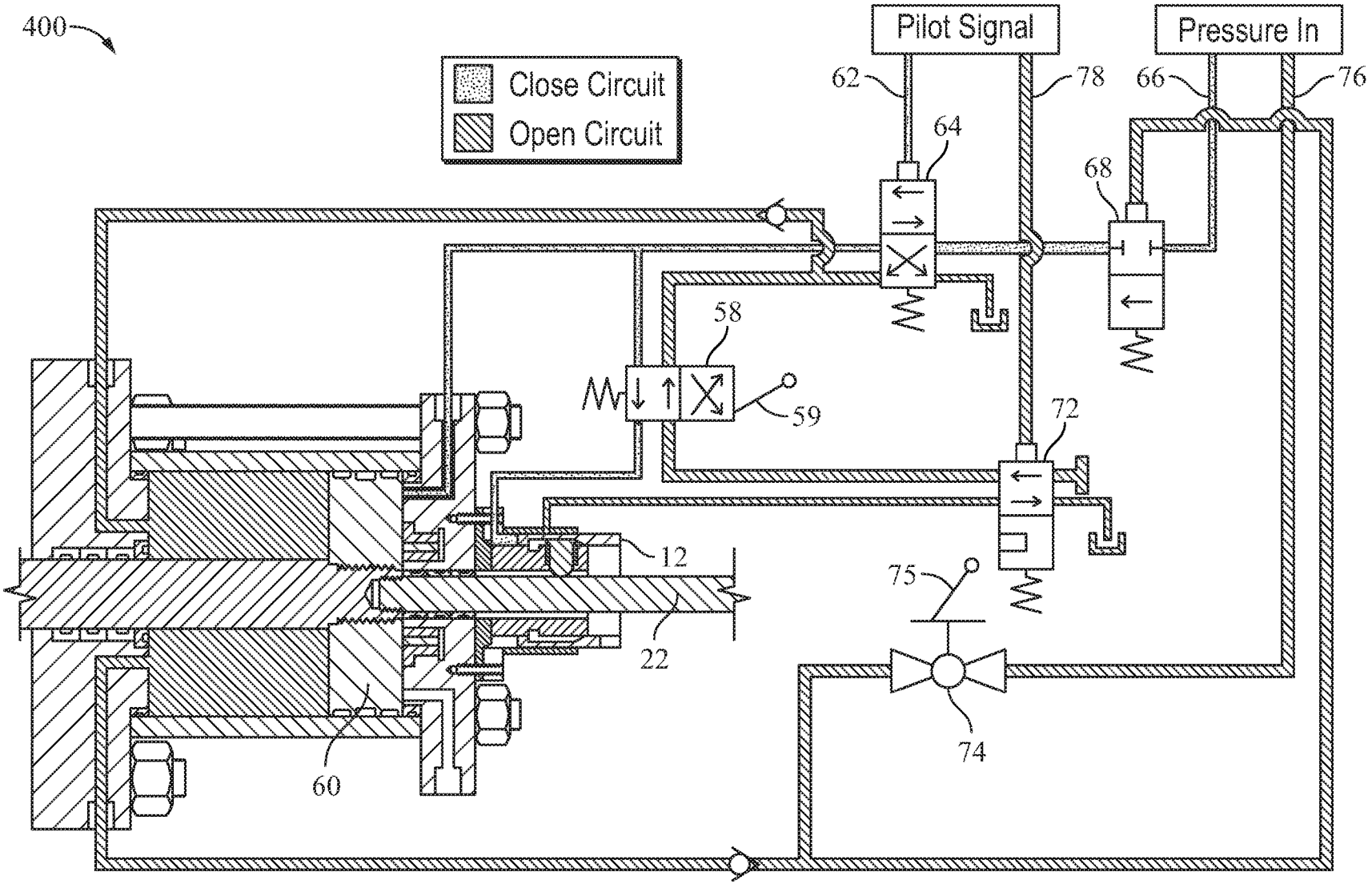
FIG. 18 is a diagrammatic view of the valve system in the closed and unlocked position moving to the open position in accord with one possible embodiment of the present invention.

FIG. 18, shows the CCD locking mechanism opening while in the unlocked position. When the position shaft 22 moves open, Valve 58 will move back to the through bore position. The pressure will deadhead in valve 68 and valve 72, leaving only the piston 60 cavity to fill. The CCD is now in the open and unlocked position. Therefore, the process can be started over again.

In summary, in this embodiment there is a preferred method for the order of operation to open or close the gates. In the fully open position, the wedge dogs are not in engagement with the machined groove and therefore the system is in the unlocked position. Additionally, the position rod and gate are fully extended outward in the open position. The system remains unlocked in the open position. Therefore, pressure may be applied to move the position rod inward to the closed position.

Once the position rod has moved to the closed position or in some embodiments the partially closed position, the locking collar may then be urged to engage the wedge dogs which in turn move them towards the position rod and the machined groove. The wedge dogs then fit within the machined groove securing the position rod in the closed and locked position.

To move the position rod back to the open position, the locking collar must be moved to disengage the wedge dogs. The wedge dogs will then retract or move away from the position rod and machined groove, therefore unlocking the system. The position rod may then be moved outward or to the open position.

A quick summary of the Sequence of Operation:

When the Actuator is to be Closed from Open Position:

Actuator "Open" position—Locking mechanism "Unlock" position

Actuator is move to "Close" position while Locking mechanism is still "Unlocked".

After actuator closed completely, the position indicator rod activates ball valves which will open hydraulic supply to locking mechanism to "Lock."

Actuator to be Opened from Close Position:

Hydraulic supply will go to locking mechanism to "unlock" first.

Once Locking mechanism "Unlocked" completely, it will open a needle valve to send hydraulic supply to actuator to start "Open"

Locking mechanism "Locks" only when gates are in closed position.

Referring to FIG. 19A, a side cross-sectional view of a CCD assembly 500 is shown in the closed and unlocked position in accord with one possible embodiment of the present invention. CCD locking mechanism 100 is mounted to each side of CCD 500 and operates in the same way; therefore only one will be described herein.

Figure 19B:
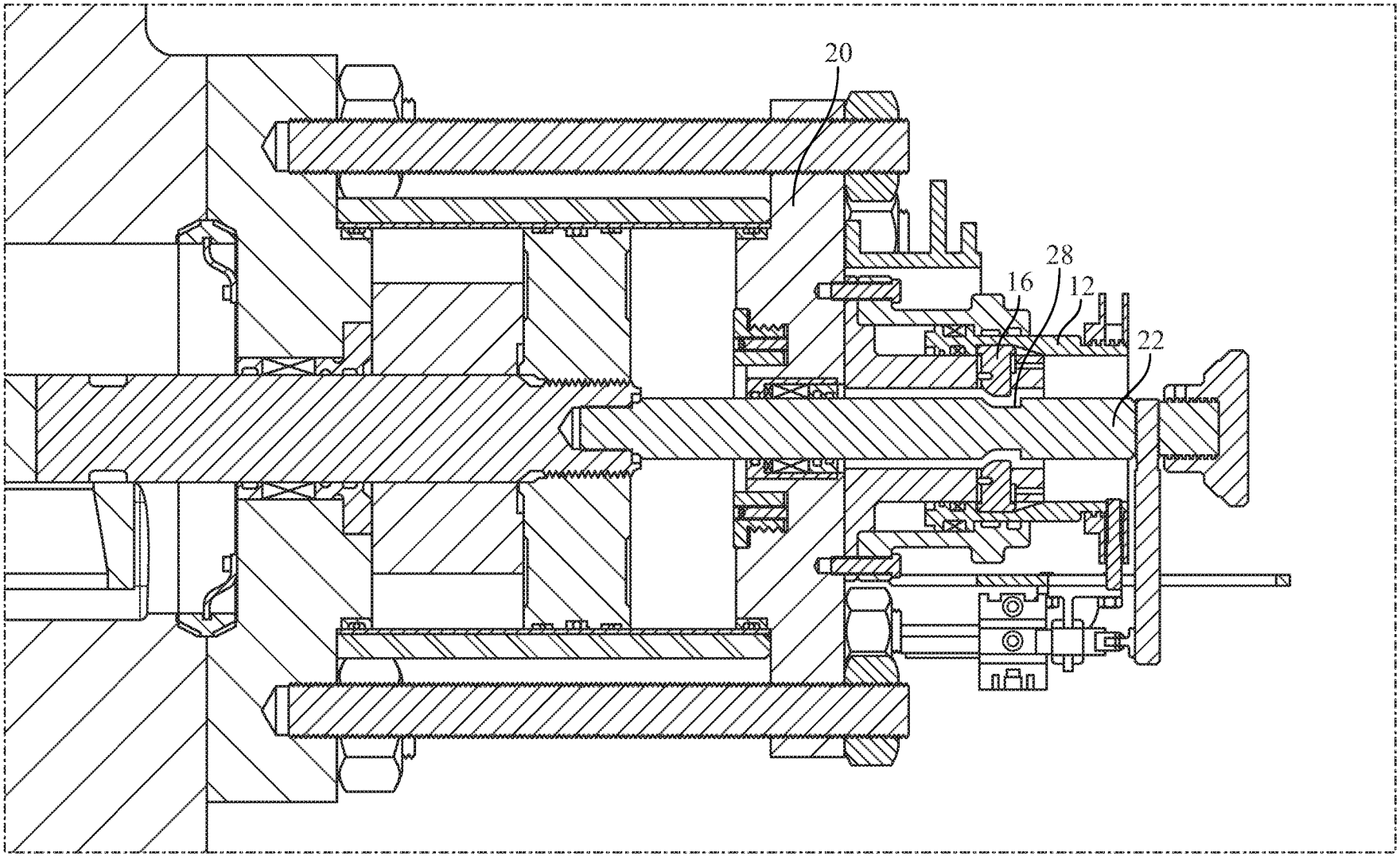
FIG. 19B is a blown up view of FIG. 19A showing CCD locking mechanism in the closed and unlocked position in accord with one possible embodiment of the present invention.

FIG. 19B is an exploded view of FIG. 19A showing CCD locking mechanism 100 in the closed and unlocked position. Position shaft 22 is moved to the farthest inward or closed position. As can be seen, wedge dogs 16 are retracted and not in engagement with machined groove 28 within position shaft 22. Locking piston collar 12 is not in engagement with the wedge dogs 16 to urge them downward into a locked position. Therefore, position shaft 22 is unlocked and in the closed position ready to be urged outward to the open position or to be secured in place in the locked position by extending the locking dogs 16 towards machined groove 28.

Referring to FIG. 20A, a side cross-sectional view of a CCD assembly 500 is shown in the closed and locked position in accord with one possible embodiment of the present invention.

Figure 20B:
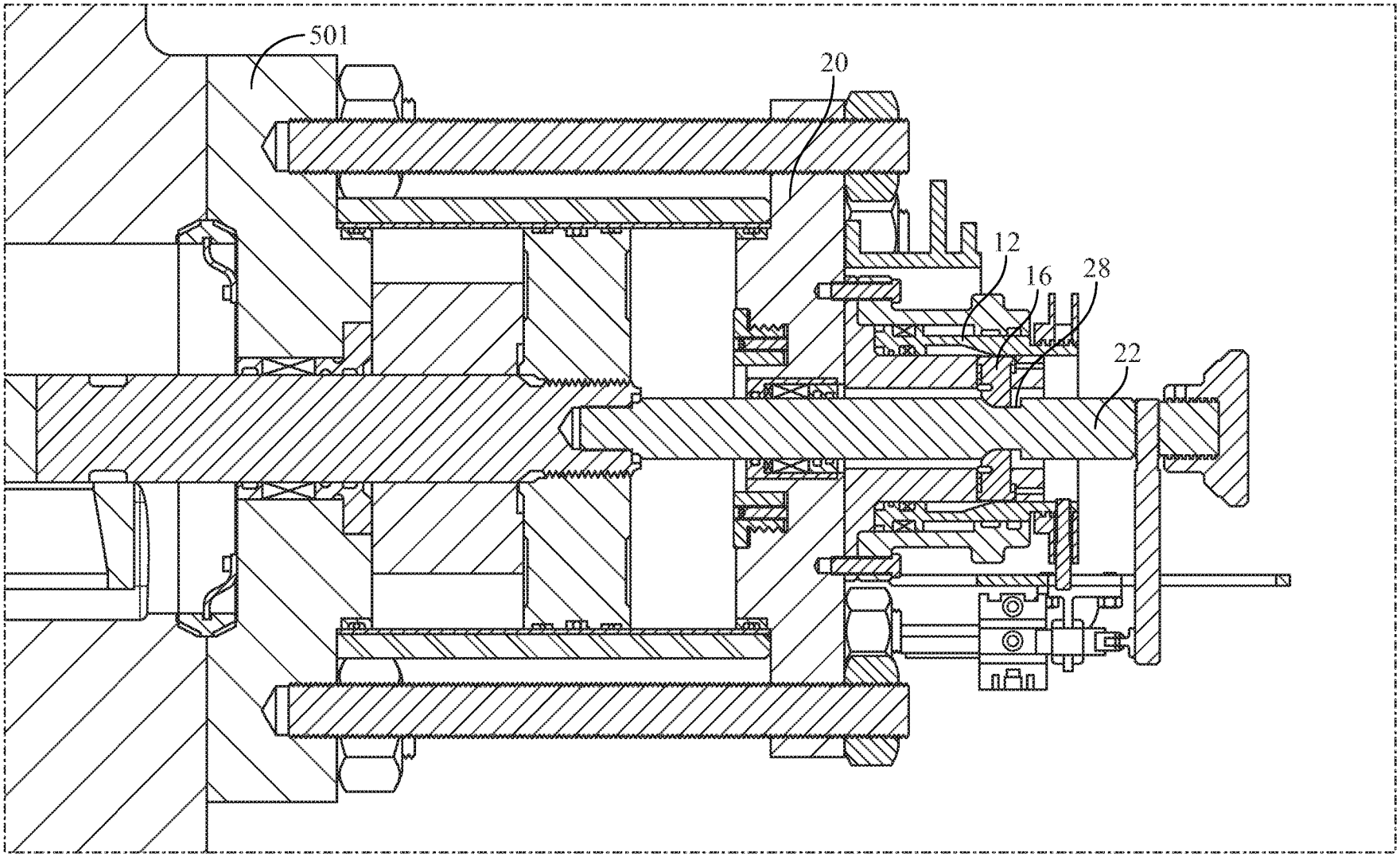
FIG. 20B is a blown up view of FIG. 20A showing CCD locking mechanism in the closed and locked position in accord with one possible embodiment of the present invention.

FIG. 20B is an exploded view of FIG. 20A showing CCD locking mechanism 100 in the closed and locked position. Position shaft 22 is moved to the farthest inward or closed position. Wedge dogs 16 are in the downward extended position and are in engagement with machined groove 28 within position shaft 22. Locking piston collar 12 is in engagement with the wedge dogs 16 to urge them downward into a locked position. Therefore, position shaft 22 is locked and secured in the closed position.

Referring to FIG. 21A, a side cross-sectional view of a CCD assembly 500 is shown in the open and unlocked position in accord with one possible embodiment of the present invention.

Figure 21B:
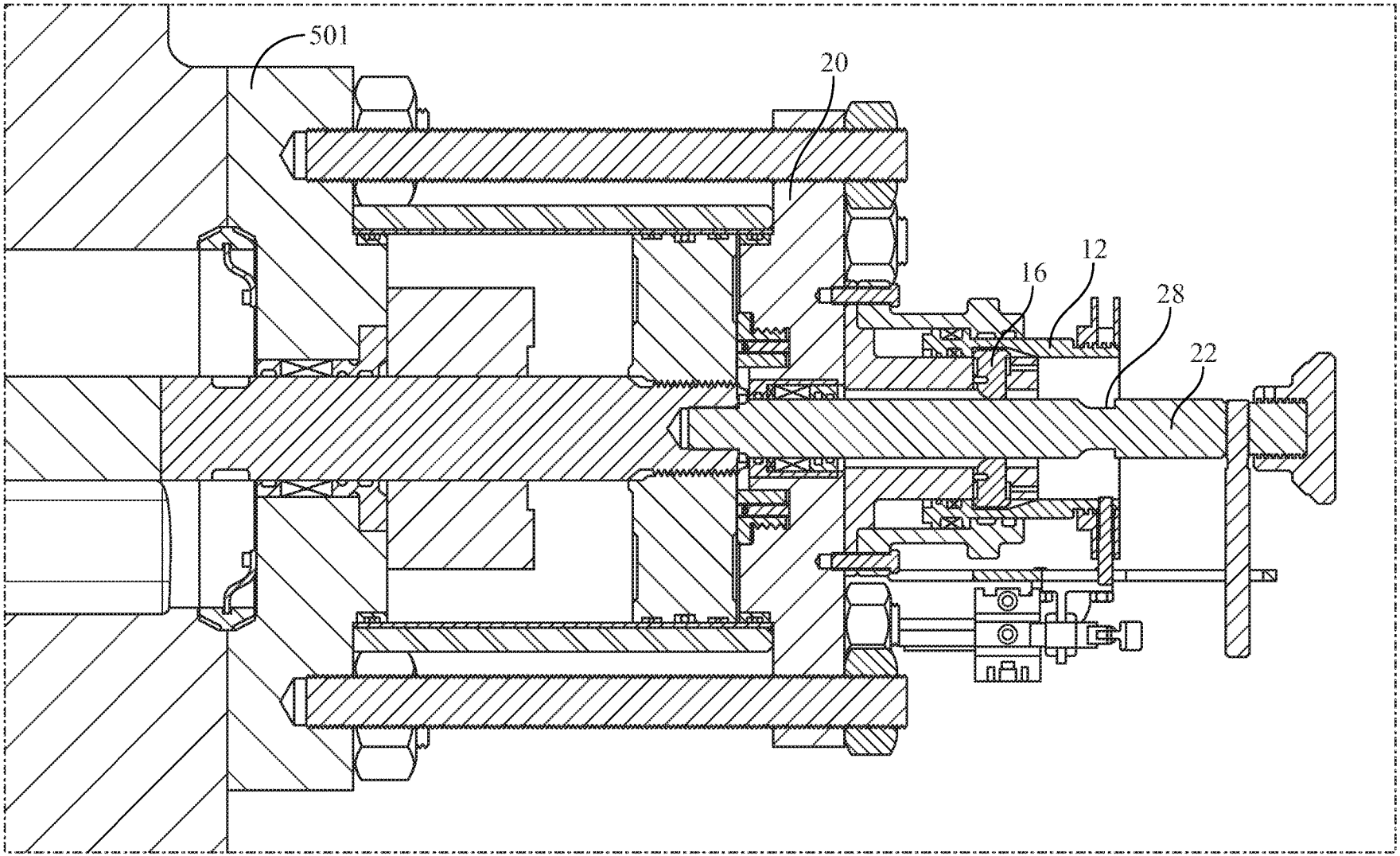
FIG. 21B is a blown up view of FIG. 20A showing CCD locking mechanism in the open and unlocked position in accord with one possible embodiment of the present invention.

FIG. 21B is an exploded view of FIG. 21A showing CCD locking mechanism 100 in the open and unlocked position. Position shaft 22 is moved to the farthest outward or open position. Wedge dogs 16 are in the retracted position and are not in engagement with machined groove 28 within position shaft 22. Locking piston collar 12 is in not engagement with the wedge dogs 16 to urge them downward into a locked position. Therefore, position shaft 22 is unlocked and in the open position.

Figure 22:
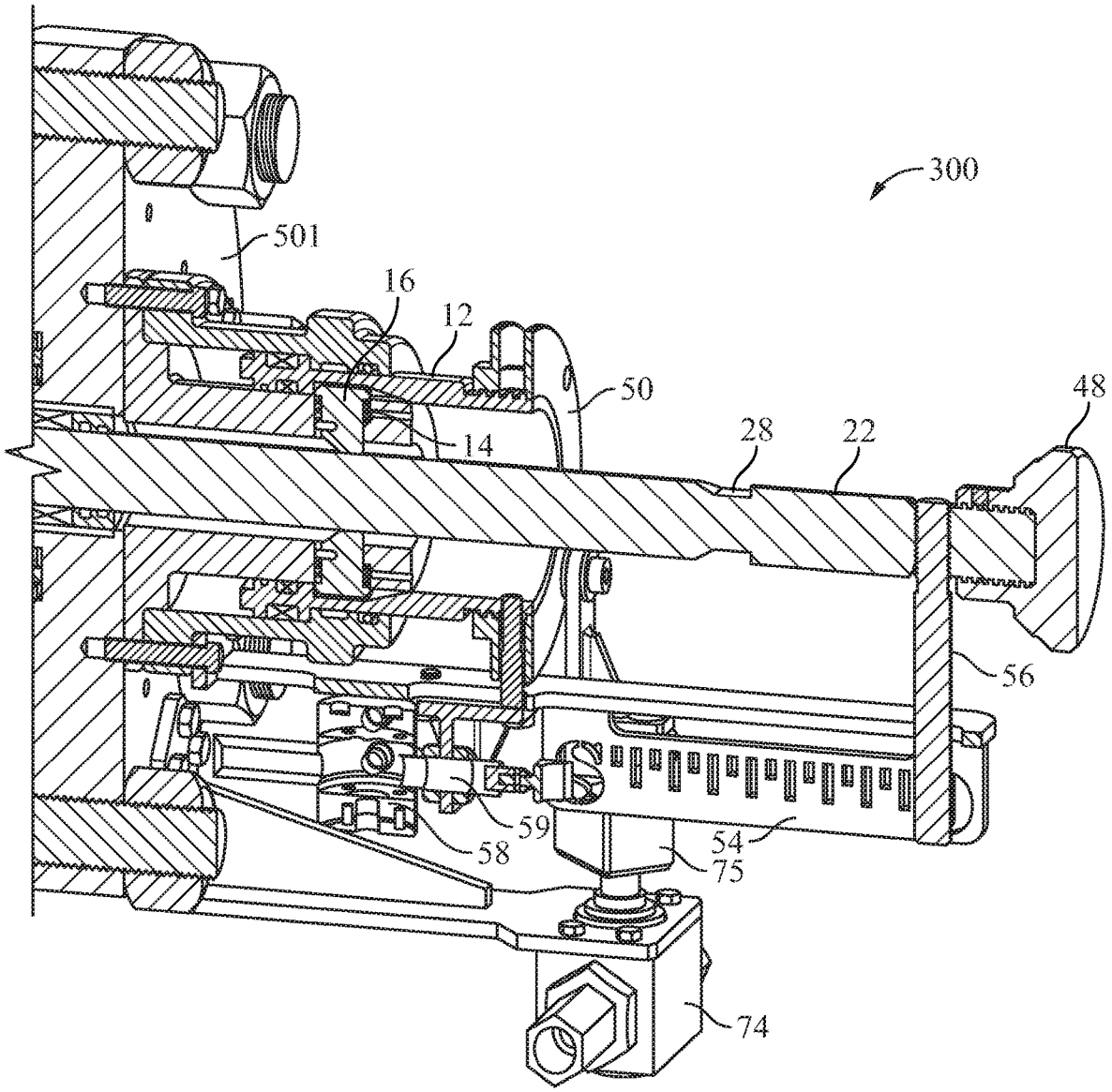
FIG. 22 is a side perspective view showing CCD locking mechanism in the open and unlocked position with valve not activated in accord with one possible embodiment of the present invention.

Referring to FIG. 22, a side cross-sectional view is shown of CCD locking mechanism in the open and unlocked position with valve not activated in accord with one possible embodiment of the present invention. In this embodiment, position shaft 22 is fully extended in the open position as indicated by position indicator 56 being aligned with the "O" position on the position scale 54. Locking collar piston 12 is extended away from wedge dog 16. Springs 14 maintain wedge dog 16 in the retracted position away from position shaft 22. Wedge dog 16 is not aligned with machined groove 28 to engage the groove and therefore is in the unlocked position. In the open position, position indicator 56 is distal valve switch 59 and has not engaged with valve switch 59 to physically actuate valve 58. For a diagrammatic view of valve 58 and valve switch 59 see FIGS. 13-14.

Figure 23:
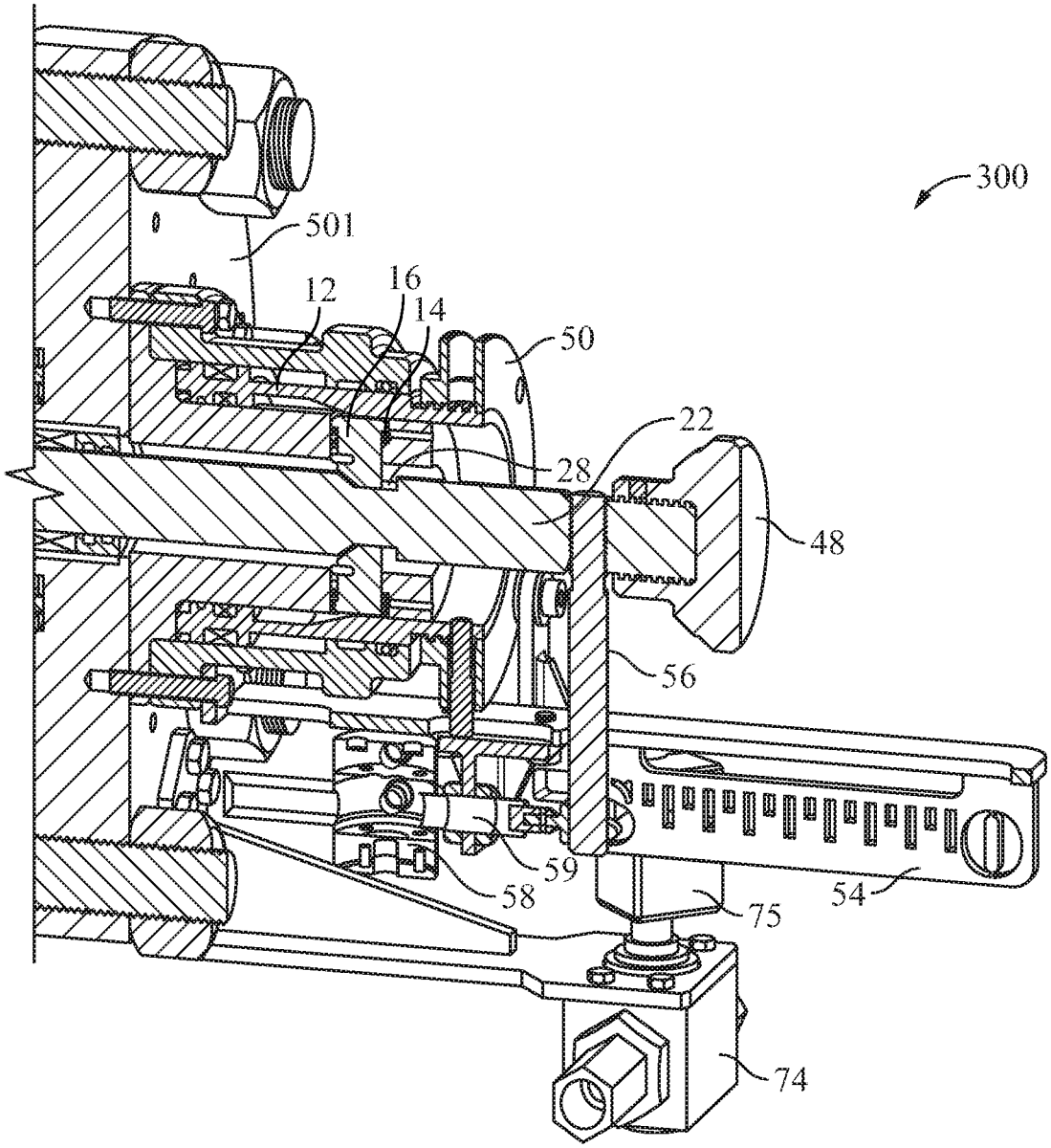
FIG. 23 is a side perspective view showing CCD locking mechanism in the closed and locked position with valve activated in accord with one possible embodiment of the present invention.

FIG. 23 is a side cross-sectional view showing CCD locking mechanism in the closed and locked position with valve activated in accord with one possible embodiment of the present invention. Position shaft 22 has been urged to the inner most closed position or shut position as indicated by position indicator 56 aligned with the "S" position on position scale 54. When the position rod ends its stroke, it will mechanically actuate valve 58. Valve 58 may be a 4 way 2 way valve or alternatively any other suitable valve. Position indicator 56 physically engages valve switch 59 switching pressure into the lock side of locking collar piston 12. In one embodiment, locking collar piston 12 then is urged to slide inward to engage wedge dog 16 downward or extended into machined recess 28. Wedge dogs 16 fit within machined recess 28 locking position shaft 22 in place in the closed and locked position. This maintains position shaft 22 in place regardless of fluid pressure in the wellbore and ensures proper sealing and safety of the gates or rams in the wellbore.

Figure 24:
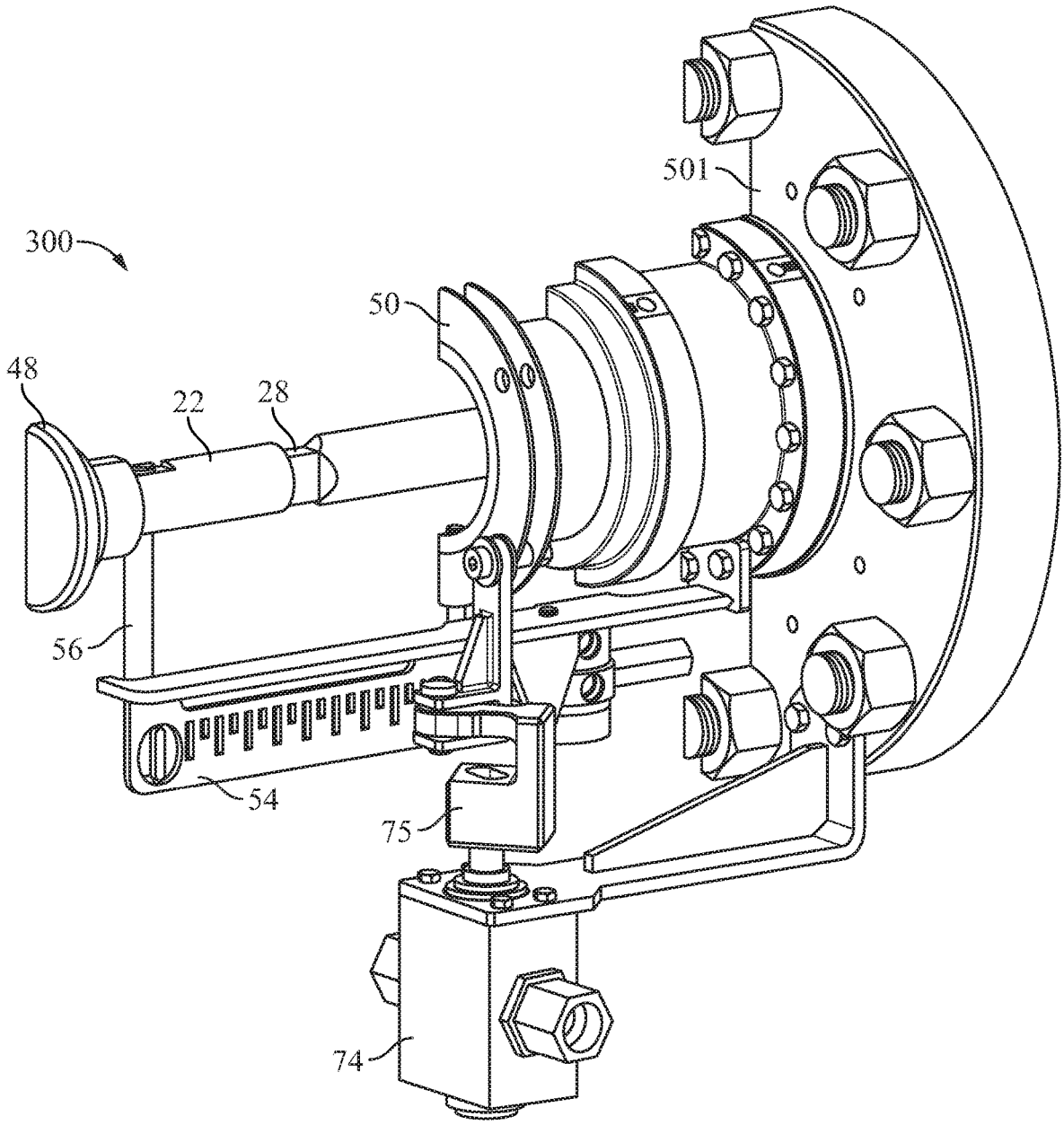
FIG. 24 is a side view showing CCD locking mechanism in the open and unlocked position with valve not activated in accord with one possible embodiment of the present invention.

FIG. 24 is a side view showing CCD locking mechanism in the open and unlocked position with valve not activated in accord with one possible embodiment of the present invention. As shown in this embodiment, position shaft 22 is in the fully extended and open position. Valve switch 75 is mechanically linked to collar piston interaction and locking piston collar 12. Valve switch 75 is not activated when the system is in the open position. Once valve switch 75 changes directions, it will cause valve 74 to open for fluid flow. Valve 74 may be a ball valve or other suitable valve for allowing fluid flow to move pistons and gates within the CCD to cut pipe or seal off the wellbore (See FIGS. 19A-21A). For a diagrammatic view of valve 74 and valve switch 75 see FIGS. 15-17.

Figure 25:
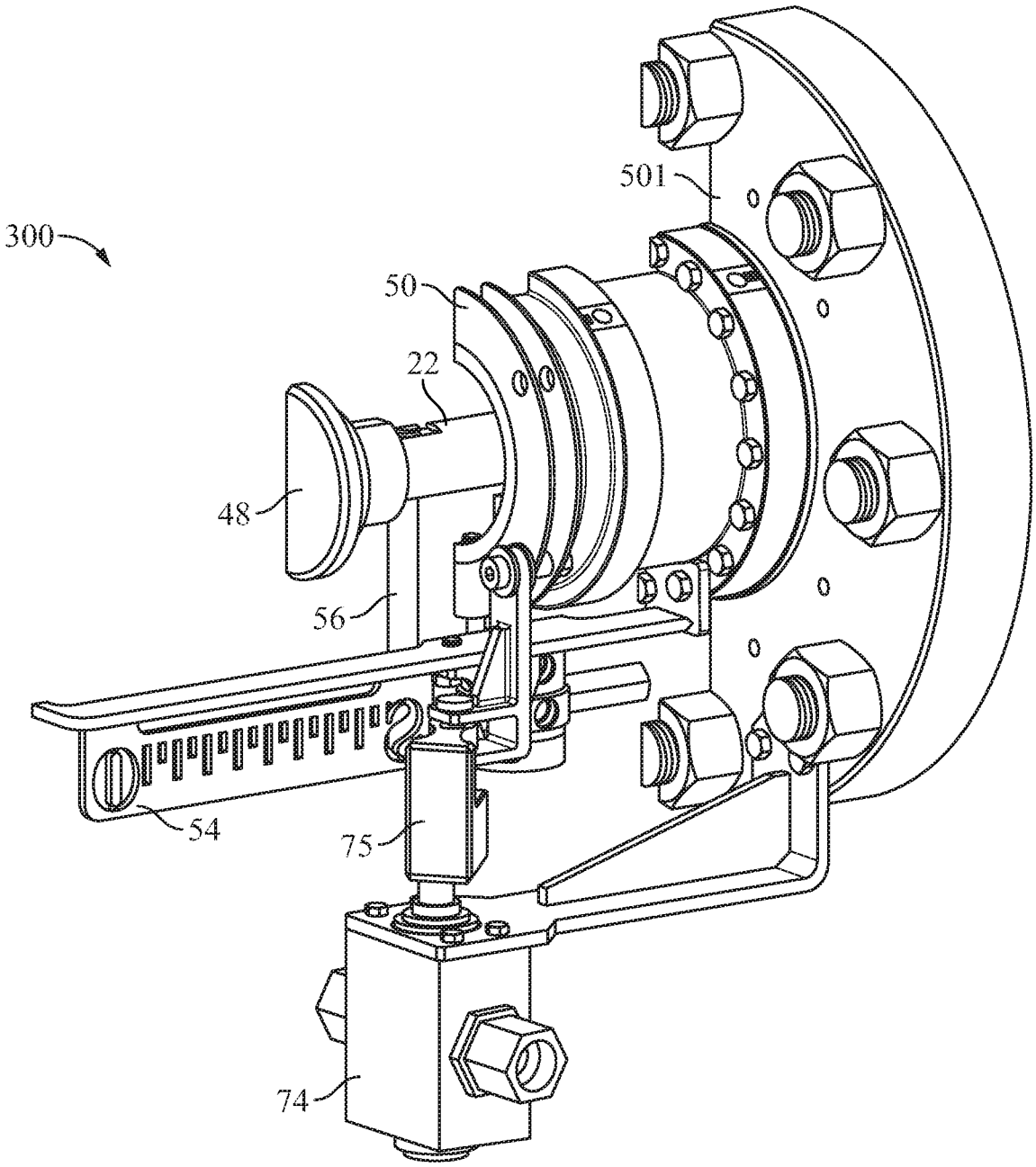
FIG. 25 is a side view showing CCD locking mechanism in the closed and locked position with valve activated in accord with one possible embodiment of the present invention.

FIG. 25 is a side view showing CCD locking mechanism in the closed and locked position with valve activated in accord with one possible embodiment of the present invention. Position shaft 22 is urged into the closed and locked position. Once the position rod has been fully closed, valve 58 opens to allow fluid flow to the locking piston collar to move into the locked position. As the locking piston collar 12 moves into the locked position, valve switch 75 is activated by mechanical linkage to open valve 74.

While the present invention is described in terms of a specific compact cutting device, the invention could be utilized for other cutting/sealing devices such as shear rams in BOPs and the like.

The foregoing description of the preferred embodiments of the invention has been presented for purposes of illustration and description only. It is not intended to be exhaustive or to limit the invention to the precise form disclosed; and obviously many modifications and variations are possible in light of the above teaching. Such modifications and variations that may be apparent to a person skilled in the art are intended to be included within the scope of this invention as defined by the accompanying claims.

The invention claimed is:

1. A locking mechanism for a subsea pipe cutter, comprising:

a subsea pipe cutter housing;

a cutter connected to a piston, the piston being responsive to hydraulic fluid to move the piston from an open position to a closed position, in the closed position the cutter shearing a pipe when a pipe is within the subsea pipe cutter;

a shaft rigidly connected to the piston, the shaft having a longitudinal axis and being moveable in a direction parallel to the longitudinal axis, the shaft comprising an outermost end and comprising a side of the shaft that extends along the longitudinal axis, the shaft extending outside a piston chamber outer wall of the subsea pipe cutter housing, the shaft defining an opening in the side of the shaft that extends along the longitudinal axis;

a piston rod connects to the piston and the cutter, the shaft being connected to the piston on an opposite side of the piston from the piston rod; and a dog mounted at a location along the longitudinal axis of the shaft, the dog being moveable between a locked position and an unlocked position, in the unlocked position the dog being outside the opening in the side of the shaft, the dog and the opening in the shaft being positioned so that the dog is moveable into the opening in the shaft to the locked position when the piston is in the closed position to thereby lock the piston in the closed position, the dog being moveable to the unlocked position outside of the opening in the shaft to allow the piston to move between the open position and the closed position.

2. The locking mechanism of claim 1 further comprising the dog comprises a dog diameter, said shaft comprises a shaft diameter, wherein the dog diameter is smaller than the shaft diameter, and at least a portion of the dog fits within the opening formed in the shaft when the dog is moved to the locked position.

3. The locking mechanism of claim 1 further comprising a lock slider movable between an unlocked position and a locked position, in the unlocked position the lock slider is shaped to permit the dog to remain in the unlocked position outside the opening on the shaft, in the locked position the lock slider is shaped to engage an engagement surface of the dog to urge the dog into the opening in the shaft.

4. The locking mechanism of claim 3, wherein the lock slider is slidable in response to hydraulic pressure, the lock slider comprising a recess and a lock surface, in the unlocked position, the lock slider being slidably positioned so that the recess in the lock slider receives the dog, in the locked position, the lock slider being slidably positioned so that the lock surface of the lock slider engages the engagement surface of the dog to urge the dog into the opening on the shaft.

5. The locking mechanism of claim 4, further comprising the lock slider is linked to a valve switch, the valve switch being responsive to movement of the lock slider, the valve switch is operable to direct a valve to allow fluid flow to move the piston to the open position or the closed position, in the closed position, the lock slider is configured to operate the valve to direct fluid to the piston, and in the open position, the lock slider moves to operate the valve to prevent fluid from flowing to the piston.

6. The locking mechanism of claim 1, wherein the dog is spring loaded to urge the dog away from the shaft.

7. The locking mechanism of claim 1, further comprising that the shaft is connected to a visual indicator that shows whether the cutter is in the open position or the closed position and wherein the visual indicator comprises a position indicator movable with the shaft, in the closed position, the position indicator is configured to engage a valve switch, the valve switch is operable to direct a valve to allow fluid flow to move a lock slider to the locked position or to move the lock slider to the unlocked position; and in the open position, the position indicator is positioned away from the valve switch, the valve switch being closed, the lock slider being in the unlocked position, the valve switch is configured to prevent fluid flow that would cause movement of the lock slider.

8. The locking mechanism of claim 1, wherein the dog is moveable between the locked position and the unlocked position only when the cutter is in the closed position.

9. The locking mechanism of claim 8, further comprising the valve switch is a ball valve.

10. The locking mechanism of claim 1 further comprising that the location at which the dog is mounted along the side of the shaft and the opening in the shaft are configured so that the dog is moveable into the opening in the shaft only when the piston is in the closed position to thereby lock the piston in the closed position.

11. The locking mechanism of claim 1 further comprising that the shaft is connected to a visual indicator that shows whether the cutter is in the open position or the closed position.

12. An override tool for a subsea pipe cutter, the subsea pipe cutter comprising a pipe cutter housing and a bore through the pipe cutter housing, a cutter connected to a shaft, a piston that moves with the shaft and the cutter between an open and a closed position, a dog mounted adjacent to the shaft, the dog being moveable to a locked position to lock movement of the shaft and the cutter when the cutter is in the closed position, a visual indicator that visually shows whether the cutter is in an open position or a closed position from a location external to the subsea pipe cutter, the override tool comprising:

an override tool cylinder;

a piston mounted in the override tool cylinder;

an override tool piston rod connected to the piston;

an override tool housing comprising a housing connector connectable to the pipe cutter housing to secure the override tool cylinder from movement with respect to the pipe cutter housing, the override tool housing being mechanically connected to the override tool cylinder;

a coupler on the override tool piston rod, the coupler being connectable to the shaft;

when the housing connector is connected to the pipe cutter housing and the coupler is connected to the shaft then the piston is operable to move the cutter between the open position and the closed position; and a rigid lock adaptor that is moveably hydraulically responsive to the override tool cylinder, said rigid lock adaptor comprising engagement surfaces to mechanically link to the dog on the subsea pipe cutter to thereby hydraulically lock and unlock the shaft.

13. The override tool of claim 12, further comprising the override tool being selectively mountable to a remotely operable vehicle.

14. The override tool of claim 12, wherein the coupler comprises an enlarged portion that interconnects to the shaft.

15. The override tool of claim 12, wherein the override tool comprises a profile that permits the visual indicator to be visible when the override tool is secured to the subsea pipe cutter.

16. The override tool of claim 12, wherein the rigid lock adaptor is hydraulically activated by the override tool cylinder.

17. The override tool of claim 12, further comprising the override tool has an open side so that the housing connector, the coupler, and the rigid lock adaptor are mountable to a portion of the pipe cutter housing by lowering the override tool onto the portion of the pipe cutter housing.

18. A method for a sequence of operation for a subsea pipe cutter, the sequence of operation comprising:

providing a cutter in the subsea pipe cutter that is operable to cut a pipe when the pipe is positioned in a bore of the subsea pipe cutter;

providing that the cutter is moveable between an open position wherein fluid flow is permitted through the bore and a closed position wherein fluid flow is prevented from flowing through the bore;

providing a piston connected to the cutter to move the cutter between the open position and the closed position;

providing that a shaft is rigidly connected to the piston;

providing an opening along a side of the shaft;

providing a dog that is moveable between an unlocked position wherein the dog is outside of the opening along the side of the shaft and a locked position wherein the dog is inserted into the opening along the side of the shaft;

wherein steps for moving the cutter to the closed position and locking the cutter in the closed position starting from when the cutter is in the open position and the dog is in the unlocked position comprise, applying hydraulic fluid to the piston to move the cutter to the closed position, and after the cutter is moved to the closed position, then providing that a valve directs hydraulic fluid to move the dog into the opening along the side of the shaft to the locked position to thereby lock the cutter in the closed position; and wherein steps for moving the cutter to the open position starting from when the cutter is in the closed position and the dog is in the locked position to secure the cutter in the closed position comprise, directing hydraulic fluid so that the dog moves out of the opening along the side of the shaft to the unlocked position, and after the dog is in the unlocked positon then applying hydraulic fluid to the piston to move the cutter to the open position.

19. The method for the sequence of operation of claim 18, further comprising providing that the shaft is mechanically linked to the valve so that after the cutter is moved to the closed position then the valve directs hydraulic fluid to move the dog to the locked position.

20. The method of claim 18, further comprising providing a piston rod between the piston and the cutter, and providing the shaft is on the opposite side of the piston as the piston rod, and providing that the shaft is a position shaft that is utilized to indicate whether the subsea pipe cutter is in the open position or closed position.

* * * * *